US008833467B2

(12) United States Patent
Gong et al.

(10) Patent No.: US 8,833,467 B2
(45) Date of Patent: Sep. 16, 2014

(54) PLUNGER LIFT SYSTEMS AND METHODS

(75) Inventors: Ming Gong, Katy, TX (US); Larry E. Harrison, Houston, TX (US); Theodore W. Pirog, Missouri City, TX (US); Robert D. Kaminsky, Houston, TX (US); Pietro Valsecchi, Houston, TX (US); Jeffrey R. Bailey, Houston, TX (US); Narasimha-Rao V. Bangaru, Pittstown, NJ (US); Swarupa S. Bangaru, legal representative, Pittstown, NJ (US)

(73) Assignee: ExxonMobil Upstream Research Company, Houston, TX (US)

( * ) Notice: Subject to any disclaimer, the term of this patent is extended or adjusted under 35 U.S.C. 154(b) by 354 days.

(21) Appl. No.: 13/321,142

(22) PCT Filed: May 20, 2010

(86) PCT No.: PCT/US2010/035627

§ 371 (c)(1),
(2), (4) Date: Nov. 17, 2011

(87) PCT Pub. No.: WO2011/002562

PCT Pub. Date: Jan. 6, 2011

(65) Prior Publication Data

US 2012/0132437 A1 May 31, 2012

Related U.S. Application Data

(60) Provisional application No. 61/222,793, filed on Jul. 2, 2009.

(51) Int. Cl.
*E21B 43/00* (2006.01)
*E21B 43/12* (2006.01)

(52) U.S. Cl.
CPC ..... *E21B 43/121* (2013.01)
USPC ..... 166/369; 166/68; 166/105.5

(58) Field of Classification Search
CPC ..... E21B 43/00; E21B 43/121
USPC ..... 166/369, 68, 105.5
See application file for complete search history.

(56) References Cited

U.S. PATENT DOCUMENTS

| | | | | |
|---|---|---|---|---|
| 2,661,024 | A | 12/1953 | Knox | |
| 3,183,470 | A | 5/1965 | Hale | |
| 4,007,784 | A | 2/1977 | Watson et al. | |
| 4,410,300 | A | 10/1983 | Yerian | |
| 4,502,843 | A | 3/1985 | Martin | |
| 4,629,004 | A | 12/1986 | Griffin | |
| 4,929,088 | A | 5/1990 | Smith | |
| 5,427,504 | A * | 6/1995 | Dinning et al. | 417/59 |

(Continued)

*Primary Examiner* — William P Neuder
(74) *Attorney, Agent, or Firm* — ExxonMobil Upstream Research Company, Law Department

(57) ABSTRACT

The present invention discloses apparatuses, systems, and methods for operating a gas well. Some embodiments include a plunger apparatus configured to fall through a continuous water phase (including water slugs) in a gas producing well by overcoming pressure and drag forces from the water by having a sufficient mass, hydrodynamic profile, and sufficiently large area for passage of the continuous water. In one embodiment, a plunger body and plug mechanism are provided, wherein the plug mechanism has open and closed positions, which may be automatically changed or controlled by a surface or other control system, and wherein the plunger body and plug may be a physically integrated one-piece system, or an interoperable two piece system.

28 Claims, 21 Drawing Sheets

(56) References Cited

U.S. PATENT DOCUMENTS

| | | | | |
|---|---|---|---|---|
| 5,880,552 | A | 3/1999 | McGill et al. | |
| 6,148,923 | A | 11/2000 | Casey | |
| 6,176,309 | B1 | 1/2001 | Bender | |
| 6,200,103 | B1 | 3/2001 | Bender | |
| 6,209,637 | B1 | 4/2001 | Wells | |
| 6,467,541 | B1 | 10/2002 | Wells | |
| 6,484,971 | B2 | 11/2002 | Layukallo | |
| 6,644,399 | B2 | 11/2003 | Abbott et al. | |
| 6,732,766 | B2 | 5/2004 | Charron | |
| 7,093,652 | B2 | 8/2006 | Gray et al. | |
| 7,121,335 | B2 | 10/2006 | Townsend | |
| 7,243,730 | B2 | 7/2007 | Casey | |
| 7,296,411 | B2 | 11/2007 | Segota et al. | |
| 7,383,878 | B1 | 6/2008 | Victor | |
| 8,181,706 | B2 * | 5/2012 | Tanton | 166/372 |
| 2005/0022998 | A1 | 2/2005 | Rogers, Jr. | |
| 2007/0001134 | A1 | 1/2007 | Lonnes | |
| 2009/0188673 | A1 | 7/2009 | Hearn et al. | |

* cited by examiner

400D

420D

PLUNGER LIFT SYSTEMS AND METHODS

CROSS-REFERENCE TO RELATED APPLICATION

This application is the National Stage of International Application No. PCT/US10/35627, filed 20 May 2010, which claims the benefit of U.S. Provisional Application No. 61/222,793, filed 2 Jul. 2009, the entirety of which are incorporated herein by reference for all purposes.

FIELD OF THE INVENTION

The presently disclosed invention relates generally to methods and systems for operating a plunger lift system. More particularly, this invention relates to a system, apparatus, and associated methods of unloading liquid in gas wells using a plunger lift system having improved hydrodynamics.

TECHNICAL BACKGROUND

This section is intended to introduce various aspects of the art, which may be associated with exemplary embodiments of the present technology. This discussion is believed to assist in providing a framework to facilitate a better understanding of particular aspects of the present technology. Accordingly, it should be understood that this section should be read in this light, and not necessarily as admissions of prior art.

Gas production from hydrocarbon reservoirs is often associated with liquid production. The produced liquids may be reservoir formation water or condensed hydrocarbon gas. During the early life of a gas well, the gas production rate is sufficient to carry produced liquid to the surface. As the reservoir pressure is depleted with continuous production, the gas production rate will eventually decrease to a point where the produced liquids can no longer be carried by gas flow out of the wellbore. As a result, the produced liquid starts to accumulate at the bottom of the well, which is called liquid loading.

Liquid loading is a common and challenging problem in gas well operations, particularly in the later life of wells. Removal of liquid, in many instances water, out of the gas well becomes important to maintain gas production and keep the well flowing. This can be accomplished by various kinds of artificial lift methods and systems. Plunger lift methods and systems are generally considered the most cost effective artificial lift approaches in the industry today.

Many conventional plunger lift systems consist of a plunger, well production tubing, a bottom hole assembly that includes tubing stopper and bumper spring, and wellhead equipment that includes plunger catcher, lubricator, flow outlet, valves, and control device. The plunger is a cylindrical device used in the tubing and it is designed to seal against the interior of the tubing while it moves freely inside the tubing string. In a typical plunger lift operation, the well is shut-in so that the plunger can descend to the bottom of the well below the accumulated continuous liquid column; after sufficient wellbore pressure has built up, the well valve is opened; the wellbore pressure pushes the plunger and, consequently, the column of liquid on top of plunger up the well all the way to surface; when reaching the surface, the plunger is held at the wellhead to allow the gas to flow for as long as the well permits; then the plunger is released into the well again for a new cycle of plunger lift operation.

The well shut-in requirement during plunger descent is one of the major disadvantages for conventional plunger lift technology. This limitation restricts the use of the technology for high rate wells because of the unaffordable production loss. Because of the hourly, periodic wellbore operation switches, a wellhead surface control system, usually comprising an electronic control panel, a power supply (for remote wells, a solar panel is very common), and pneumatic flow-control valves, becomes essential.

Continuous flow plungers such as those described in U.S. Pat. No. 6,209,637, U.S. Pat. No. 6,644,399, and U.S. Pat. No. 7,243,730 attempt to address the well shut-in time problem. However, each of the devices and methods disclosed in these patents requires a surface control device. Surface control devices keep the cost high for plunger operations. While providing flexibility or options for optimizing plunger lift operations, the surface control system typically accounts for more than 80% of the total capital expense of a plunger lift system installation. In addition, none of the current plungers are applicable in high rate gas producing wells and none of them appear to utilize improved hydrodynamics.

Field experiences have shown that continuous flow plungers have difficulty reaching the tubing bottom in high flow rate wells. This may be due to a lack of sufficient mass, an inability to overcome hydrodynamic forces such as pressure and drag caused by continuous water, or another design limitation.

What is needed are more efficient and effective plunger lift systems and methods for artificially lifting liquids out of gas wells that can operate with or without surface control equipment and operate in high rate gas producing wells.

SUMMARY

One embodiment of the present invention discloses a one-piece plunger apparatus. The apparatus includes a plunger body having a substantially annular cross-section and an outer diameter, wherein the outer diameter is slightly less than an inner diameter of a tubing string of a gas producing well; a flow channel through the plunger body; and a plug mechanism physically integrated with the plunger body and having a closed position and an open position, the open position configured to permit the passage of a continuous water slug past the plug mechanism and through the flow channel, wherein the plug mechanism extends from the plunger apparatus and comprises a substantially streamlined profile. Particular embodiments of the apparatus are further configured to fall through the continuous water slug in the gas producing well at a falling velocity relative to the continuous water slug velocity greater than about (150+50×M) feet per minute (ft/min), where M is the mass in units of lbm of the plunger apparatus; and further comprise an actuation member operatively engaged with the plug mechanism, extending outwardly from the plug mechanism, and having a surface area exposed to the continuous water in the gas producing well smaller than a surface area of the plug mechanism exposed to the continuous water in the gas producing well and the surface area exposed to the continuous water having a streamlined profile, wherein the plunger apparatus falls in the open position until the actuation member encounters a first actuation force causing the plug mechanism to automatically move to the closed position. Alternatively, the one-piece apparatus may include a locking device configured to impart a force on the plug mechanism in the open position, wherein the force is sufficient to maintain the plug mechanism in the open position as the plunger apparatus falls through continuous water at the falling velocity.

A second embodiment of the present invention includes a two-piece plunger apparatus. The apparatus includes a plunger body having a substantially annular cross-section and an outer diameter, wherein the outer diameter is slightly less than an inner diameter of a tubing string of a gas producing well; a flow channel through the plunger body; and a plug mechanism releasably connected to the plunger body and having a closed (connected) position and an open (released) position, the open position configured to permit the passage of continuous water through the flow channel while maintaining the open position, wherein the plug mechanism comprises a substantially streamlined profile. More particular embodiments of the second embodiment include the plunger body and flow channel comprising a profile, wherein at least a portion of the profile is selected from the group consisting of: a substantially streamlined profile, a substantially tapered profile, and any combination thereof; and the plunger body and the plug mechanism are each configured to fall through continuous liquids in the gas producing well at a falling velocity relative to the continuous liquids velocity greater than about (150+50×M) feet per minute (ft/min), where M is either the mass in units of lbm of the plunger body or the mass in units of lbm of the plug mechanism.

Particular embodiments of the first and second embodiments may further include operation in a high rate gas producing well of over about 200 thousand standard cubic feet per day (kscf/d).

A third embodiment of the present invention discloses an automatic plunger apparatus. The apparatus includes a plunger body having a first end, a second end, a substantially annular cross-section configured to form a flow channel through the plunger body from the first end to the second end; and a plug mechanism configured to move between a closed position configured to obstruct the flow of fluids through the flow channel and an open position configured to permit the flow of fluids through the flow channel, wherein the plunger apparatus is configured to travel in the general direction of a gravitational force ("fall") in the open position until the plunger apparatus engages a first actuation force causing the plug mechanism to automatically move to the closed position; and may be further configured to travel against the general direction of the gravitational force in the closed position until the plunger apparatus engages a second actuation force causing the plug mechanism to automatically move to the open position.

The third embodiment may optionally include a support element configured to operatively engage the plug mechanism and fixedly attach to the flow channel; and a locking apparatus having an actuation member operatively engaged with the plug mechanism and the support element. The locking apparatus may further include: a first end configured to extend beyond an outer surface of the plug mechanism when the valve element is in the open position and to engage the plug mechanism in the open position until the first actuation force causes the actuation member to disengage from the plug mechanism and forces the plug mechanism to the closed position, and a second end of the actuation member configured to extend beyond an upper portion of the support element when the plug mechanism is in the closed position and to engage the plug mechanism in the closed position until a second actuation force causes the actuation member to disengage from the plug mechanism and forces the plug mechanism to the open position, wherein the plunger body and the plug mechanism are configured to maintain the open position when the plug mechanism engages a hydrodynamic drag force caused by a flow of continuous liquids in a gas producing well.

Alternative particular embodiments of the third embodiment may include a support element configured to operatively engage the plug mechanism and fixedly attach to the flow channel; and a locking apparatus. The locking apparatus including: at least one locking device configured to operatively engage the plug mechanism in the open position with a locking force, wherein the locking force is sufficiently large to hold the plug mechanism in the open position when the plug mechanism engages a hydrodynamic drag force caused by a flow of continuous liquids in a gas producing well, but wherein the locking force is sufficiently small that the plug mechanism moves to the closed position when the plug mechanism engages the first actuation force, wherein the at least one locking device is selected from the group consisting of: 1) magnetic latches, 2) compression rings, 3) spring-loaded ball bearings, and 4) any combination thereof.

Some arrangement of the third embodiment may also include wherein the first end of the plug mechanism has a streamlined shape, comprising a surface area sufficiently large to maintain its streamlined shape upon impact from the first actuation force, but sufficiently small to minimize a hydrodynamic drag force caused by contact with the continuous water in the gas producing well.

A fourth embodiment of the present invention discloses a method of producing hydrocarbon-containing gas. The method includes providing a hydrocarbon well having a wellbore, a flow line in fluid communication with the wellbore, a top portion with a tubing head stopper, and a bottom portion with a bottom bumper stopper; producing a volume of liquids and a gaseous stream imparting a gaseous pressure from the bottom portion to the top portion of the wellbore; and operating an automatic plunger apparatus in the wellbore in a plunger lift cycle. The lift cycle includes: 1) lifting at least a portion of the produced volume of liquids towards the top portion of the wellbore and out of the flow line utilizing the gaseous pressure from the bottom portion to the top portion of the wellbore, wherein the automatic plunger apparatus is in a closed position; 2) impacting the tubing head stopper with the automatic plunger apparatus causing the automatic plunger apparatus to automatically change its operating state from the closed position to an open position; 3) descending the automatic plunger apparatus in the open position to the bottom of the wellbore, wherein a gravitational force on the plunger apparatus is greater than a combined drag force and pressure force on the plunger apparatus caused by the passage of the volume of fluids and the gaseous stream; 4) impacting the bottom bumper stopper with the automatic plunger apparatus causing the automatic plunger apparatus to automatically change its operating state from the open position to the closed position; and 5) repeating the plunger lift cycle.

The method may also include controlling the plunger lift cycle, comprising: i) catching the automatic plunger apparatus at or near the top portion of the wellbore; ii) holding the automatic plunger apparatus for a period of time; and iii) releasing the automatic plunger apparatus upon the occurrence of a condition in the wellbore.

A fifth embodiment of the invention discloses a method of manufacturing the first embodiment. The method includes forming the plunger body out of a single piece of material; fixedly attaching the support element to the flow channel; and slidably attaching the valve element to the support element. The method may optionally include slidably attaching the locking apparatus to the valve element.

Particular embodiments of the first, second, and third embodiments may further include a side-wall geometry selected from the group consisting of: 1) a solid ring sidewall, 2) a plurality of turbulent sealers along the sidewall, 3) a plurality of fluid sealing elements configured to generate an azimuthal variation of a toroidal vortex in the cavity geometry, 4) a shifting ring sidewall, 5) a pad plunger sidewall having spring-loaded interlocking pads, 6) a brush type sidewall, and 7) any combination thereof; and wherein the plunger apparatus is configured to operate in a gas producing well comprising: i) a lower stopper with a bumper spring configured to provide the first actuation force; and ii) an upper stopper with a bumper spring and an extension rod configured to provide the second actuation force.

Particular embodiments of the first, second, third, fourth, and fifth embodiments may further include further comprising a friction reduced coating on at least a portion of the plunger apparatuses, wherein the FRC is selected from the group consisting of: diamond-like carbon (DLC), advanced ceramics, graphite, and near-frictionless carbon (NFC).

BRIEF DESCRIPTION OF THE DRAWINGS

The foregoing and other advantages of the present techniques may become apparent upon reviewing the following detailed description and drawings in which.

DETAILED DESCRIPTION

Figure 1A:
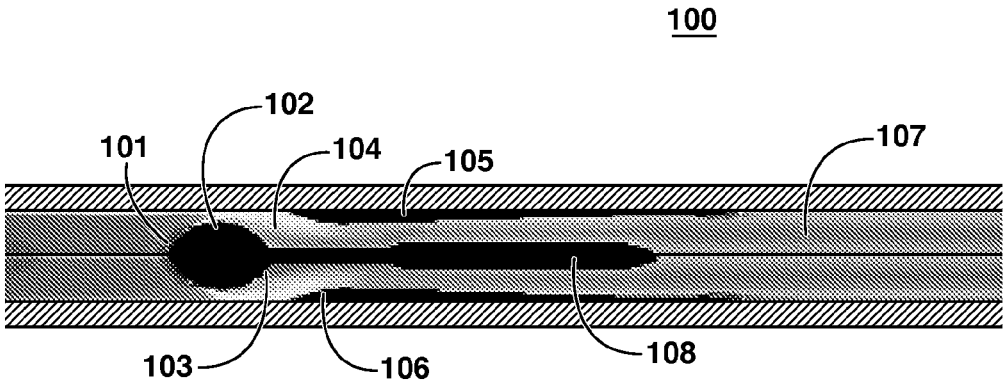
FIGS. 1A-1D show four exemplary one-piece plunger profiles in accordance with certain aspects of the present disclosure.

In the following detailed description section, specific embodiments of the present invention are described in connection with preferred embodiments. However, to the extent that the following description is specific to a particular embodiment or a particular use of the present invention, this is intended to be for exemplary purposes only and simply provides a description of the exemplary embodiments. Accordingly, the invention is not limited to the specific embodiments described below, but rather, it includes all alternatives, modifications, and equivalents falling within the true spirit and scope of the appended claims.

DEFINITIONS

Various terms as used herein are defined below. To the extent a term used in a claim is not defined below, it should be given the broadest definition persons in the pertinent art have given that term as reflected in at least one printed publication or issued patent.

The terms "a" and "an," as used herein, mean one or more when applied to any feature in embodiments of the present inventions described in the specification and claims. The use of "a" and "an" does not limit the meaning to a single feature unless such a limit is specifically stated.

The term "about" is intended to allow some leeway in mathematical exactness to account for tolerances that are acceptable in the trade. Accordingly, any deviations upward or downward from the value modified by the term "about" in the range of 1% to 10% or less should be considered to be explicitly within the scope of the stated value.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

The term "continuous water" or "water slug" refers to a volume of water encountered in a well sufficient to impart at least a "liquid load" on a plunger falling through the well. Note that the water will generally be water produced from a subterranean formation and may include some production fluids, drilling fluids, gases, and other materials that a person of ordinary skill in the art would expect to find in a well.

The term "exemplary" is used exclusively herein to mean "serving as an example, instance, or illustration." Any embodiment described herein as "exemplary" is not necessarily to be construed as preferred or advantageous over other embodiments.

The terms "preferred" and "preferably" refer to embodiments of the inventions that afford certain benefits under certain circumstances. However, other embodiments may also be preferred, under the same or other circumstances. Furthermore, the recitation of one or more preferred embodiments does not imply that other embodiments are not useful, and is not intended to exclude other embodiments from the scope of the inventions.

The term "releasably connected," as used herein, means two parts or physical elements that are capable of a connected mode of operation and a disconnected or separate mode of operation. In the connected mode, the two parts or elements are sufficiently connected to operate as a single physical element. The two parts or elements are releasable in that they can be released from each other or disconnected without damaging either of the two elements such that they can be reconnected without having to be remanufactured in any way. Examples of releasable connections include clips, magnetic attachments, threaded attachments, pressure connections, spring-loaded connections, and the like. Examples of "permanent connections" that would not be considered "releasable" include welded connections, bolted connections, and the like.

The term "streamlined profile," as used herein, means a shape that is longest in the direction of travel and tapered on both ends such as to promote streamlined flow of fluids around the profile or shape and specifically excludes substantially spheroid shapes.

The terms "substantial" or "substantially," as used herein, mean a relative amount of a material or characteristic that is sufficient to provide the intended effect. The exact degree of deviation allowable may in some cases depend on the specific context.

The definite article "the" preceding singular or plural nouns or noun phrases denotes a particular specified feature or particular specified features and may have a singular or plural connotation depending upon the context in which it is used.

Description of Embodiments

Embodiments of the disclosed plunger comprise a cylindrical tubular body that possesses a sealing means at its outer perimeter surface, a plug-type valve element that is used to open or close the plungers internal flow path thus creating a continuous interface between liquid and pressured gas when the plunger ascends in the well, and a reliable locking mechanism that prevents the accidental engagement of the plunger valve outside of the operational design parameters.

The cylindrical tubular body of any of the disclosed plungers is adapted to travel within tubing strings, such as production tubing strings, of gas production wells. The cylindrical tubular body of any of the disclosed plungers may be of any size suitable for travel within the tubing strings in which the plunger will be utilized. For example, the present plungers may be installed in tubing strings having inner diameters ranging between about 1 inch and about 6 inches. Common production tubulars range between about 1.05 inches and about 4.5 inches and having corresponding inner diameters somewhat smaller than these outer dimensions, with tubulars being sized at virtually any incremental size within those ranges, such as 2⅜ inches, 2⅞ inches, 3½ inches, etc. While the sizes are expressed here in inches, it should be understood that corresponding metric dimensions may be used and denominated depending on the application. Regardless of the inner diameter size of the tubing string in which the plunger travels, the tubular plunger body is configured to provide a substantially annular cross-section and to have an outer diameter sized to fit the tubing strings. For example, the outer diameter of the plunger body may be slightly less than the inner diameter of the tubular string. As will be understood, the outer diameter of the plunger body should be less than the inner diameter of the tubular string to reduce the contact friction forces between the plunger body and the tubing string. Exemplary clearances between the plunger body outer diameter and the tubing string inner diameter may be within the range from about 0.1 inches to about 0.001 inches. In an exemplary implementation having 2⅜ inch tubing with 1.995 inch nominal inner diameter and a drift inner diameter of 1.901 inches, a recommended plunger body outer diameter may be between about 1.89 inches and about 1.90 inches. In some implementations, the outer diameter of the plunger body may be slightly less than the inner diameter of the tubing string, wherein slightly less is limited only by the manufacturing tolerances of the components where the outer diameter is sized to prevent binding. Additionally or alternatively, the outer diameter may be selected based at least in part on fluid dynamics considerations, such as described further below. In such implementations, the outer diameter and the configuration of the outer surface of the plunger body may be suitably engineered to create the desired flow properties.

Embodiments of the disclosed plunger lift systems include one-piece ("integrated") plunger configurations as well as two-piece configurations. The one-piece configurations include a plug mechanism physically integrated with the plunger body and having a closed position and an open position. The open position of the plug is configured to permit the passage of continuous water (or water slug) past the plug mechanism and through the flow channel of the plunger body, wherein the plug mechanism extends from the plunger apparatus in a direction of travel and comprises a substantially streamlined profile.

The two-piece embodiments include a plunger body and a plug mechanism releasably connected to the plunger body and having a closed (connected) position and an open (released) position, the open position configured to permit the passage of continuous water through the flow channel while maintaining the open position, wherein the plug mechanism comprises a substantially streamlined profile.

Some embodiments of the disclosure include a two-stage locking mechanism. The function of the locking mechanism is to ensure that the valve element remains in the desired position during plunger operations. The locking mechanism prevents the valve element from undesirably engaging when the plunger splashes at a high descending speed into a water slug. On the other hand, the locking mechanism can be unlocked by an actuation force when the plunger reaches the subsurface bumper spring at the bottom of the well configured to engage the locking mechanism.

The wellhead assembly of the system has two primary functions. The first is to actuate the plunger from a closed position to an open position when the plunger comes to the wellhead so that the plunger can fall back against fluid flows. The second is to absorb the impact from a plunger traveling at a high speed to prevent potential equipment damage.

The application of the presently disclosed technology is not only limited to subsurface operation. Since control devices are not required, the system can be installed in the subsurface wellbore, which adds significant flexibility and makes different wellbore equipment configurations available.

One particular advantage of the present disclosure is to provide plunger lift systems that are applicable in high rate (e.g. over about 200 kscf/d) gas wells and capable of unloading more water than conventional, existing plunger lift systems. At the same time, embodiments of the plunger lift system are able to lift produced liquid to the surface while automatically cycling in a well. The capability of avoiding shutting-in the well and improving liquid unloading capacity make embodiments of this invention effective and economic field tools or devices for unloading liquid from gas wells.

Some of the advantages of the presently disclosed methods and apparatuses include: 1) The system can work automatically without the assistance of control equipment; 2) The plunger lift system can be installed or run subsurface in gas wells; 3) Expanded application range of plunger lift system to high rate gas wells; 4) Can be used in conjunction with control devices in order to optimize plunger operations; and 5) Permits use of multiple multi-stage automatic plungers.

In general, a plunger surrounded by flowing fluids is subject to four primary forces: gravity force, fluid drag force, pressure force, and friction force due to contact with tubing. The gravity force is always pointing downwards to the earth while the directions of the drag and pressure forces are the same as the direction of flow of fluids relative to the plunger, while the contact force acts opposite to the direction of travel of the plunger. In a producing well with a falling plunger, the drag, pressure, and contact forces are pointing upwards, i.e. against gravity. The magnitude difference between gravity force and drag, pressure, and contact forces determines whether the plunger descends, ascends, or remains suspended in the wellbore. When the gravity force is greater than the combined drag force, pressure force, and contact force, the plunger falls in the wellbore. Otherwise, the plunger will suspend or move upwards with the flowing fluids. The greater the difference is, the faster the plunger falls (e.g. the greater the plunger's "falling velocity").

Improving the plunger falling velocity may be achieved by any one of the following strategies: 1) increasing the weight of plunger so as to increase gravity force; 2) mitigating the pressure force on the plunger by reducing restriction to flow, e.g. the effective cross-sectional area (normal to the flow) of the plunger; 3) mitigating the drag force on the plunger by streamlining the profile of the plunger; and 4) reducing the frictional force due to contact between the plunger and the tubing. In the following exemplary embodiments of the disclosure, some combination of these strategies will be used.

One-Piece Plunger Configurations

Figure 1B:
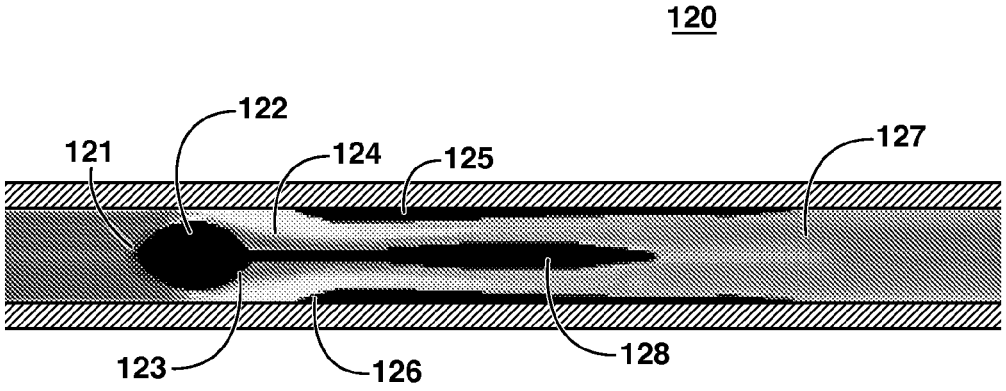
Figure 1C:
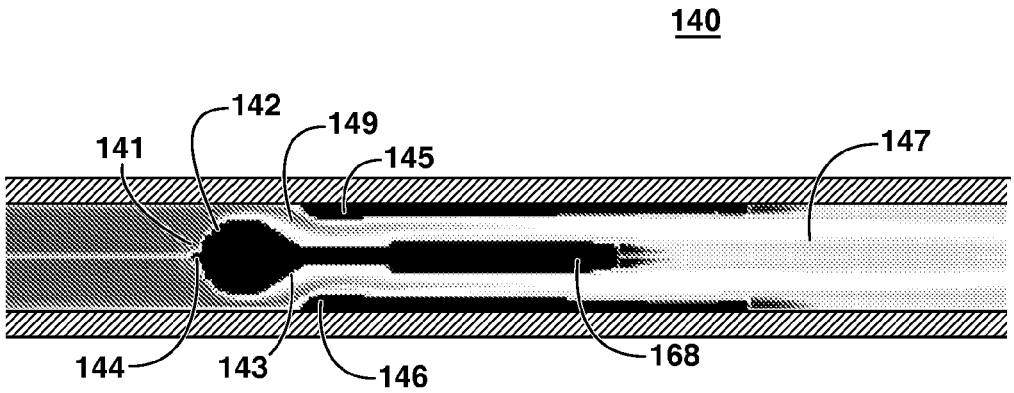

Referring now to the figures, FIGS. 1A-1C show three exemplary one-piece plunger profiles in accordance with certain aspects of the present disclosure. Each of the profiles 100, 120, 140, and 160 are internal profiles configured or designed to mitigating the drag force on the plunger by streamlining the profile of the plunger. FIG. 1A shows a profile 100 of a one-piece plunger design having a plug mechanism 101, a plunger body 105, a support mechanism 108, and a flow channel 107 through the plunger body, wherein the plug mechanism 101 has a hydrodynamic front edge 102 and a low-drag back edge 103, a low resistance gap 104 is formed between the plug mechanism 101 and the plunger body 105, and the plunger body 105 has a hydrodynamic front edge 106. Theoretical drag forces are shown with the plunger profile 100 that indicate a small high resistance force at the tip of the front edge 102 and a very low resistance force in the low resistance gap 104.

FIG. 1B shows a profile 120 of a one-piece plunger design having a plug mechanism 121, a plunger body 125, a support mechanism 128, and a flow channel 127 through the plunger body, wherein the plug mechanism 121 has a hydrodynamic front edge 122 and a low-drag back edge 123, a low fluid pressure gap 124 is formed between the plug mechanism 121 and the plunger body 125, and the plunger body 125 has a hydrodynamic front edge 126. Theoretical drag forces are shown with the plunger profile 120 that indicate a small high resistance force at the tip of the front edge 122 and a low resistance force in the low resistance gap 124, which continues past the support mechanism 128, probably due to a lower profile hydrodynamic front edge 126 on the plunger body 125.

FIG. 1C shows a profile 140 of a one-piece plunger design having an integrated plug mechanism 141 having a button-like protrusion 144, a plunger body 145, a support mechanism 148, and a flow channel 147 through the plunger body, wherein the integral plug mechanism 141 has a hydrodynamic front edge 142 and a low-drag back edge 143, the protrusion 144 also having a hydrodynamic shape, a low fluid pressure gap 149 formed between the plug mechanism 141 and the plunger body 145, and the plunger body 145 has a hydrodynamic front edge 146. Theoretical drag forces are shown with the plunger profile 140 that indicate a very low resistance force at the tip of the front edge 142 and a medium to high resistance force in the low fluid pressure gap 149, as compared to the other profiles 100 and 120.

Figure 1D:
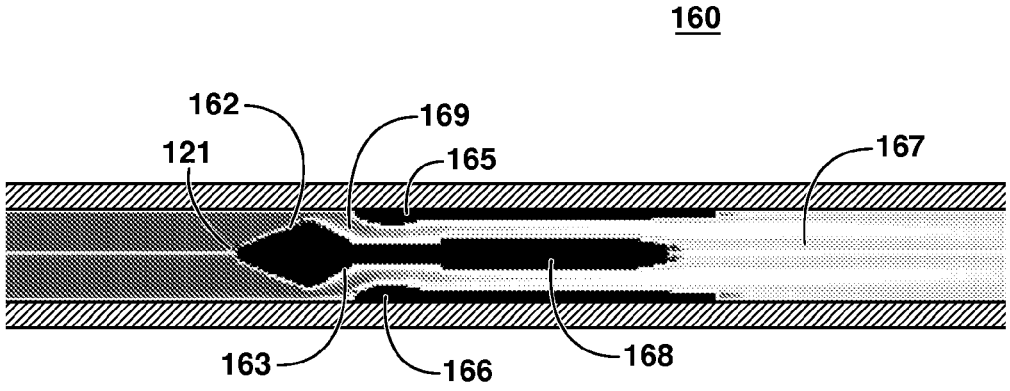

FIG. 1D shows a profile 160 of a one-piece plunger design having a plug mechanism 161, a plunger body 165, a support mechanism 168, and a flow channel 167 through the plunger body, wherein the plug mechanism 161 has a hydrodynamic front edge 162 and a low-drag back edge 163, a low fluid pressure gap 164 is formed between the plug mechanism 161 and the plunger body 165, and the plunger body 165 has a hydrodynamic front edge 166. Theoretical drag forces are shown with the plunger profile 160 that indicate similar resistance forces at the tip of the front edge 162 and in the low fluid pressure gap 169 as compared with profile 140.

In the exemplary profiles 100, 120, 140, and 160 the plunger apparatus is a one-piece apparatus, with a plunger body (105, 125, 145, or 165) having a substantially cylindrical shape with a flow channel (107, 127, 147, or 167) through the body, and a plug mechanism (101, 121, 141, or 161) configured to have an open position to permit fluid flow through the flow channel and a closed position configured to block fluid flow, wherein the plug mechanism extends from the plunger apparatus in a direction of travel (e.g. down the well) and comprises a substantially streamlined profile. Note that the profiles 100, 120, 140, and 160 all show the plug mechanism 101, 121, 141, and 161 in the open position. A "streamlined profile," as used herein, means a shape that is longest in the direction of travel and tapered on both ends such as to promote streamlined flow of fluids around the profile or shape and specifically excludes substantially spheroid shapes. In one specific, exemplary embodiment, the streamlined profile or shape has its maximum diameter at the anterior third of the plug mechanism 101, 121, 141, and 161 with a length to width ratio of 4.5. Alternatively, the streamlined profile may be referred to as a "tear drop" shape. The plug mechanism profiles 101, 121, 141, and 161 are all considered to have substantially streamlined profiles for purposes of the disclosure.

In one particular embodiment, the plug mechanism 101, 121, and 141 may further include an actuation member 144 operatively engaged with the plug mechanism, extending outwardly from the plug mechanism, and having a surface area exposed to the continuous water in the gas producing well smaller than a surface area of the plug mechanism exposed to the continuous water in the gas producing well. In operation, the plunger apparatus falls in the open position until the actuation member encounters a first actuation force causing the plug mechanism to automatically move to the closed position. In addition, the portion of the actuation member exposed to the continuous water may have a smooth profile to reduce hydrodynamic drag forces on the actuation member 144 and the plug mechanism 101, 121, or 141. One benefit of such an actuation member 144 is that the impact force imparted on the actuation member 144 by the continuous water and other liquids in the well (including water slugs) will generally be mitigated due to the small surface area and the smooth shape such that the impact force will not be sufficient to actuate the plug mechanism 101, 121, or 141 to the closed position.

It should be noted, however, that some embodiments, such as plug mechanism 161, are not configured to include an actuation member 144. The actuation member 144 may only be a feature when using a two-stage locking mechanism (e.g. the plug mechanism is biased in both the open and closed positions) and may not be included when a one-stage locking mechanism is utilized.

In the open position, the plunger apparatus profile (100, 120, 140, or 160) is configured to mitigate the effects of the pressure force and dynamic drag forces on the plunger apparatus caused by the flow of fluids, such as produced gases, water, and hydrocarbon liquids. Of particular interest is the mitigation or reduction of a pressure force caused by the plunger falling through continuous water (e.g. a water slug) in a high rate (e.g. about 200 kscf/d) gas well.

Two-Piece Plunger Configurations

Figure 2A:
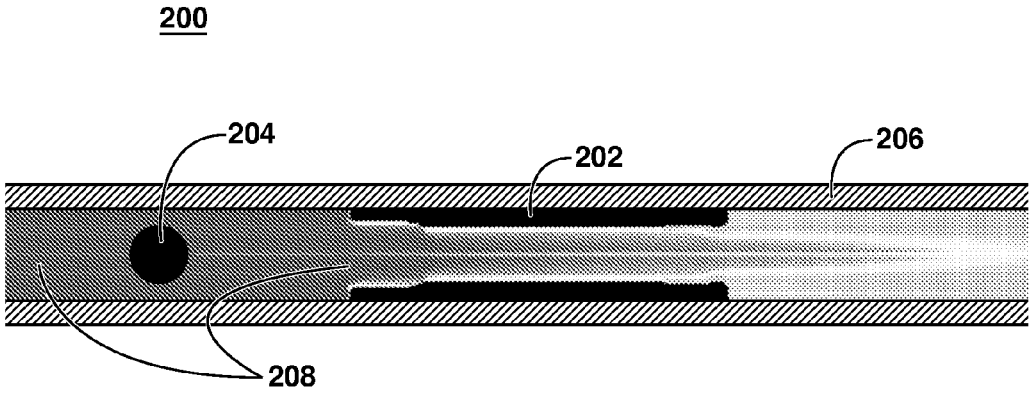
FIG. 2A Prior Art
FIGS. 2A-2C show three exemplary two-piece plunger profiles.
Figure 2B:
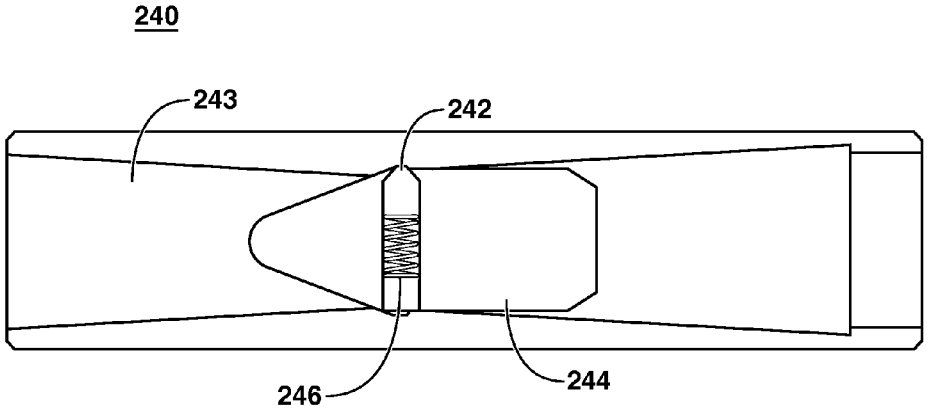
Figure 2C:
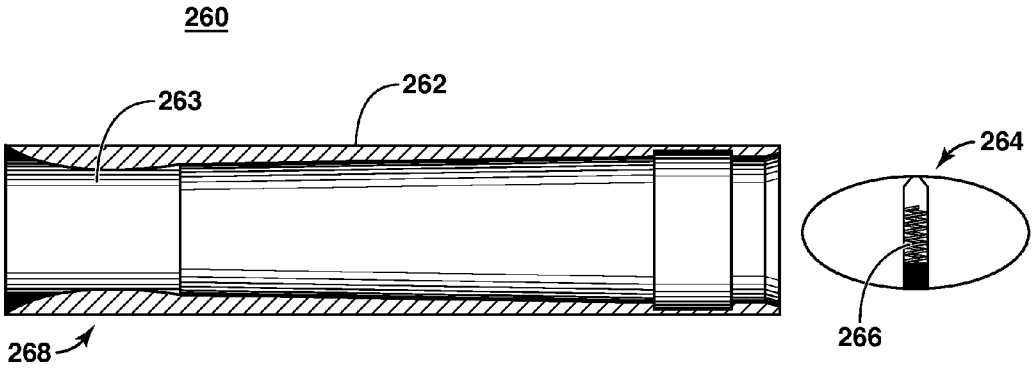

FIGS. 2A-2C show three exemplary two-piece plunger profiles. FIG. 2A shows a profile 200 of the cylindrical plunger body 202 and a plug mechanism 204 of an exemplary prior art two-piece plunger as it travels down a well tubing 206. A pressure profile obtained using computational fluid dynamics (CFD) modeling is also shown, including two high pressure zones 206. There is no pressure profile provided for the plug mechanism 204, but the plug 204 is in the shape of a sphere, which is not a streamlined shape because it creates a turbulent wake, which increases the hydrodynamic drag force on the sphere.

FIG. 2B shows a profile 240 of an exemplary two-piece plunger apparatus in accordance with aspects of the present disclosure. The profile 240 includes a generally cylindrical plunger body 242, a flow channel 243 through the plunger body 242, a plug mechanism 244, which is releasably connected to the plunger body 242 and having a closed (connected) state and an open (released) state, and a locking mechanism 246. The plug mechanism 244 has a shape configured to sit in the opening of the flow channel 263 such that it blocks fluid flow therethrough in the closed (connected or locked) position. The plug mechanism 244 is shaped to provide a tapered profile to reduce hydrodynamic drag on the plug 244 as it moves through fluids.

FIG. 2C shows a profile 260 of an exemplary two-piece plunger apparatus including a generally cylindrical plunger body 262, a flow channel 263 through the plunger body 262, a plug mechanism 264, having a closed (connected) state and an open (released) state, a locking mechanism 266, and a front (leading) edge portion 268. The plug mechanism 264 is releasably connectable to the plunger body 262 by the locking mechanism 266 and is shown in the released state. The plug mechanism 264 has a shape configured to sit in the opening of the flow channel 263 such that it blocks fluid flow therethrough in the closed (connected or locked) position. The plug mechanism 264 is also shaped to provide a substantially streamlined profile to reduce drag on the plug 264 as it moves through fluids.

In certain embodiments, the locking mechanisms 246 and 266 may be magnetically actuated, mechanically actuated, compression ring actuated, spring-and-ball actuated, some combination thereof, or some other appropriate locking actuation means known to persons of skill in the art. It should also be noted that although the exemplary profiles 240 and 260 show plug mechanisms 244 and 264 that trail the plunger body 242 or 262, the disclosure is not limited to such an embodiment and includes a plug mechanism configured to fall through the well tubing ahead of the plunger body (as is the case in the prior art plunger profile 200).

The exemplary profiles 240 and 260 show the plunger apparatus as a two-piece apparatus, with a plunger body (242 or 262) having a substantially cylindrical shape with a flow channel (243 or 263) through the plunger body, and a plug mechanism (244 or 264) releasably connectable to the plunger body and having a closed (e.g. connected) state and an open (e.g. released) state, the open state configured to permit the passage of continuous liquids through the flow channel while maintaining the open position, wherein the plug mechanism comprises a substantially streamlined profile. Note that the plug mechanism 244 is in the closed or connected position and includes an illustration of a spring actuated locking mechanism 246, while plug mechanism 264 is in the open or released state.

In an additional illustrative embodiment, the plunger body and flow channel may have a profile that is substantially streamlined, substantially tapered, or some combination thereof. For example, the plunger body 242 illustrates a "tapered" profile, wherein the front or leading edge of the plunger body is rounded and is the most narrow portion of the plunger body, while the middle portion of the plunger body is the most thick, where the thickness change gradually transitions to promote streamlined flow through the flow channel 243. In another exemplary embodiment, the plunger body 262 shows an illustration of a streamlined profile at the leading or front edge 264 of the plunger body 262.

Figure 3:
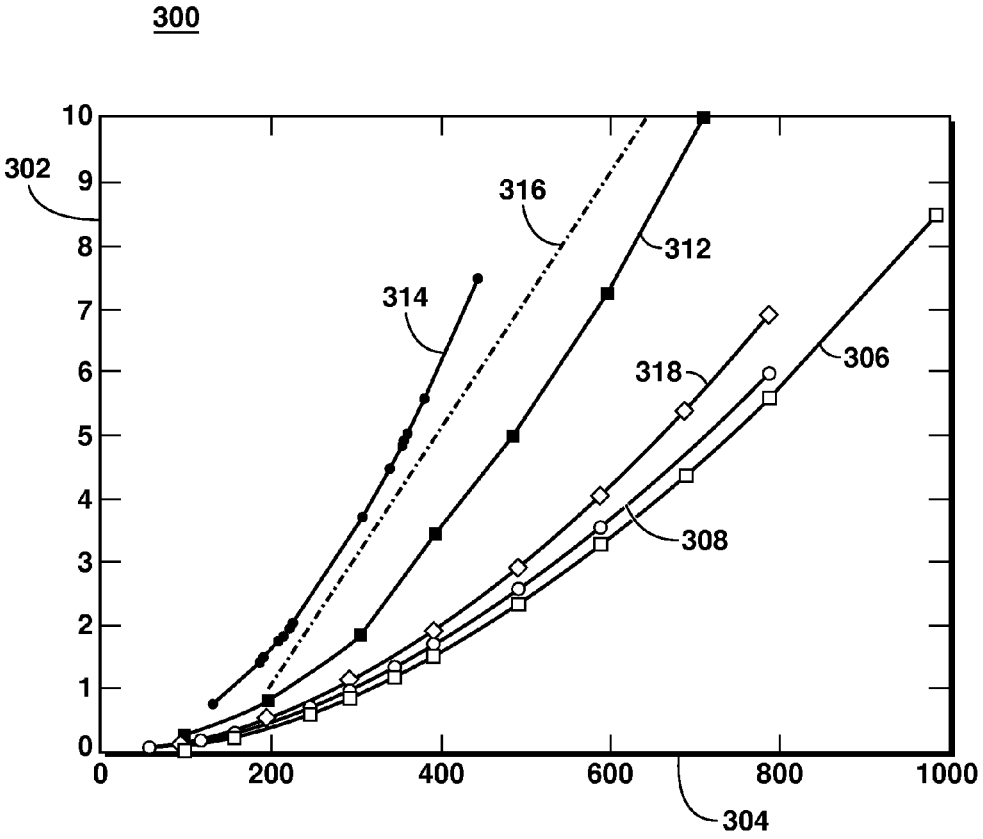
FIG. 3 illustrates a graph comparing plunger falling speed with total force on the plunger body of the various plunger profiles of FIGS. 1A-1C and 2A-2B.

FIG. 3 illustrates a graph comparing CFD modeled plunger falling speed with total force on the plunger body of the various plunger profiles of FIGS. 1A-1C and 2A-2B. As such, FIG. 3 may be best understood with reference to FIGS. 1A-1C and 2A-2B (the one-piece profile in FIG. 1D and the two-piece profile in FIG. 2C were not modeled). Before describing the details of FIG. 3, it should be noted that the CFD modeled data depicted in FIG. 3, as well as that data represented by the flow profiles of FIGS. 1A-1C and 2A-2B, were obtained using an exemplary plunger and tubing string combination, wherein the exemplary tubing string had an inner diameter of about 2 inches and the plunger had a corresponding outer diameter. As is well understood in the field of computation fluid dynamics, characterizations of flow rates, forces, and velocities are relative to the size of the cross-sectional flow area. While the discussion herein references particularly volumetric flow rates and particular velocities and forces, it is understood that such references relate to an exemplary implementation using a tubing string having an inner diameter of about 2 inches. Of course, tubing strings, such as production tubing, come in a variety of inner diameters. The present methods and systems can be scaled up or down as appropriate for a particular implementation. The data represented in FIG. 3 is merely representative of the modeled exemplary implementation, and should not be considered limiting.

The graph 300 includes a y-axis 302 showing the total force due to mass on the plunger body, measured in pounds mass ($lb_m$) and an x-axis 304 showing the falling velocity of the plunger body as a function of the total force 302 in feet per minute (ft/min). The graph 300 includes plot 306 showing the modeled performance of profile 120, plot 308 showing the modeled performance of profile 140, plot 310 showing the modeled performance of profile 100, plot 312 showing the modeled performance of profile 240, and plot 314 showing the modeled performance of profile 200. In addition, lines 316 and 318 show a baseline performances equivalent to about 150+50M ft/min and 120+80M ft/min, where M is the mass of the plunger in $lb_m$. These models are not considered comprehensive, but are considered to include enough variables to obtain relative performance parameters between plunger profiles. As shown in the graph, profile 120 has the best performance in the group and the prior art plunger body 200 was the worst performing plunger profile and the only profile to fall slower than the baseline performance line 316.

Another factor in plunger performance is whether or not the plunger is capable of performing under certain conditions. In particular, if the plunger design will get suspended in the well at high gas flow rates such as, e.g. over about 200 thousand standard cubic feet per day (kscf/d). In particular, the plunger will need to have a sufficient falling velocity to overcome high flow rates. This is most significant in the case where liquids such as water are present in the gas producing well in the form of a slug, a continuous volume of liquids, or a multi-phase flow having gas and liquids (water, hydrocarbon liquids such as gas condensates, and other liquids). Beneficially, the disclosed profiles 100, 120, 140, 160, 240, and 260 are believed to fall at a sufficient rate to overcome the hydrodynamic drag forces in a high rate gas well.

Additional factors may also be considered when designing a plunger for performance in a high rate well. In plunger design, it is generally known that the following operating characteristics are desirable in any plunger, regardless of the type of operation: high repeatability of plunger valve (e.g. plug mechanism) operation, high shock and wear resistance, and resistance to sticking in the tubing. It may also be desirable that the plunger provide a good seal against the tubing during upward travel and be relatively inexpensive to fabricate. Increasing the mass of the plunger results in higher impact force when the plunger strikes a surface or subsurface plunger stopping device. When the impact force exceeds the yield strength of the plunger or plunger stopping devices, permanent damage may result. When designing a plunger, the mass of the plunger should be optimized to fall through production fluids at a sufficiently high rate (e.g. greater than about 150+50M ft/min or about 120+80M ft/min) and to avoid being suspended or pushed up the tubing in the open position, without causing permanent damage to the plunger or plunger stopping devices.

Beneficially, a less massive plunger may be utilized if the plunger body is configured to mitigate the pressure force on the plunger body and mitigate the dynamic drag force on the plunger body. Reducing the thickness of plunger body would reduce the mass of the plunger if other dimensions are kept unchanged. However, reducing the plunger body thickness may also reduce its ability to withstand the repetitive impact forces encountered in an artificial lift operation.

In comparing the shape and performance of the exemplary profiles 100, 120, 140, 160, 200, 240, and 260, it can be appreciated that profile 120 appears to have the best falling performance 306. However, profiles 140 and 160 have very good falling performance 308, while maintaining some robustness (thickness), having fewer pointed edges (e.g. 122 versus 142 and 162), and potentially being less expensive to manufacture (see, e.g. the shape of the support elements 128, 148 and 168). It may also be appreciated that the button 144 on profile 140 may be sufficient to mitigate the hydrodynamic drag forces on the plunger.

Figure 4A:
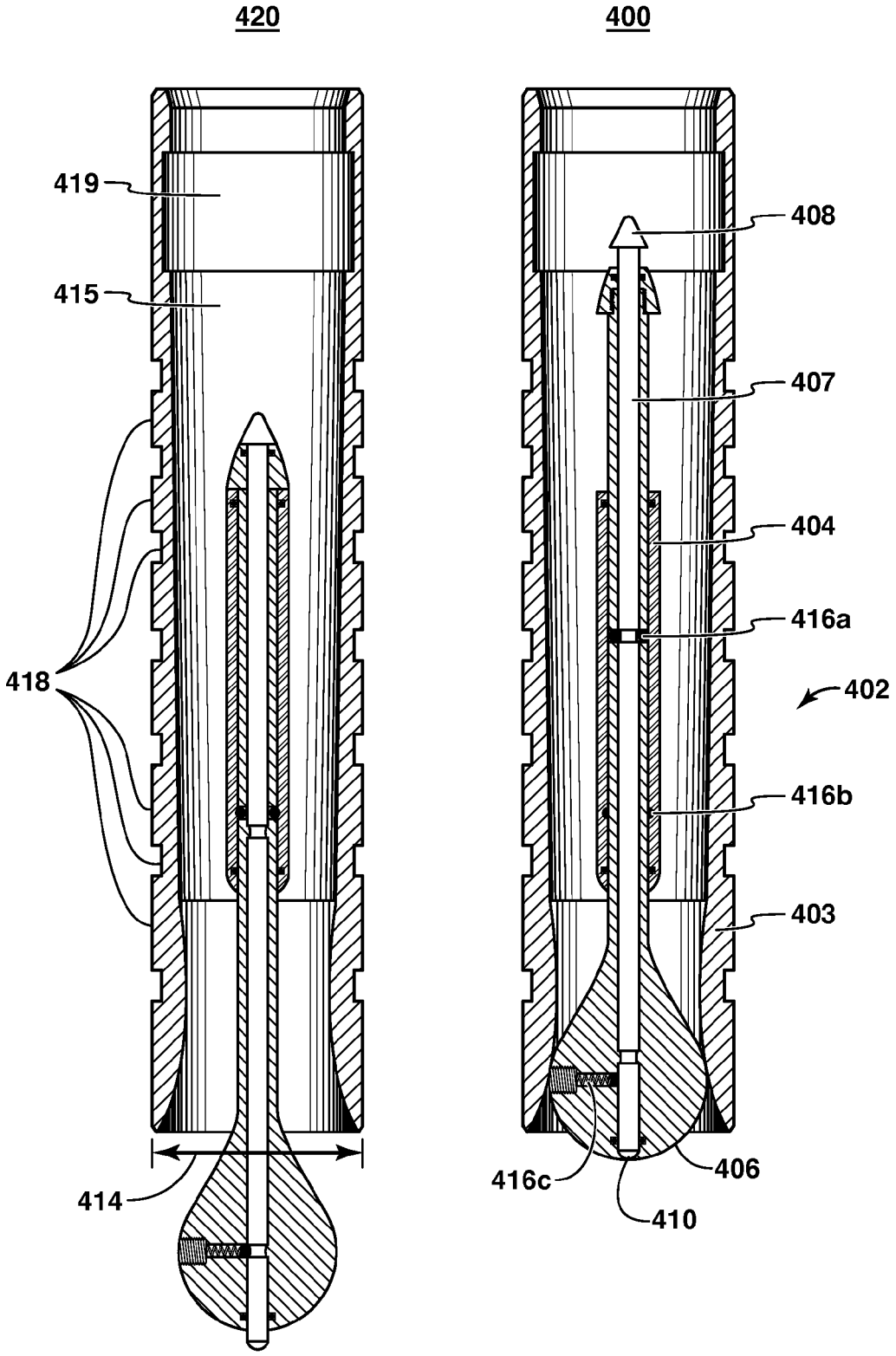
FIGS. 4A-4D show longitudinal-cut, cross-sectional views of four exemplary one-piece plunger apparatuses, including the internal locking mechanisms of the plungers.
Figure 4B:
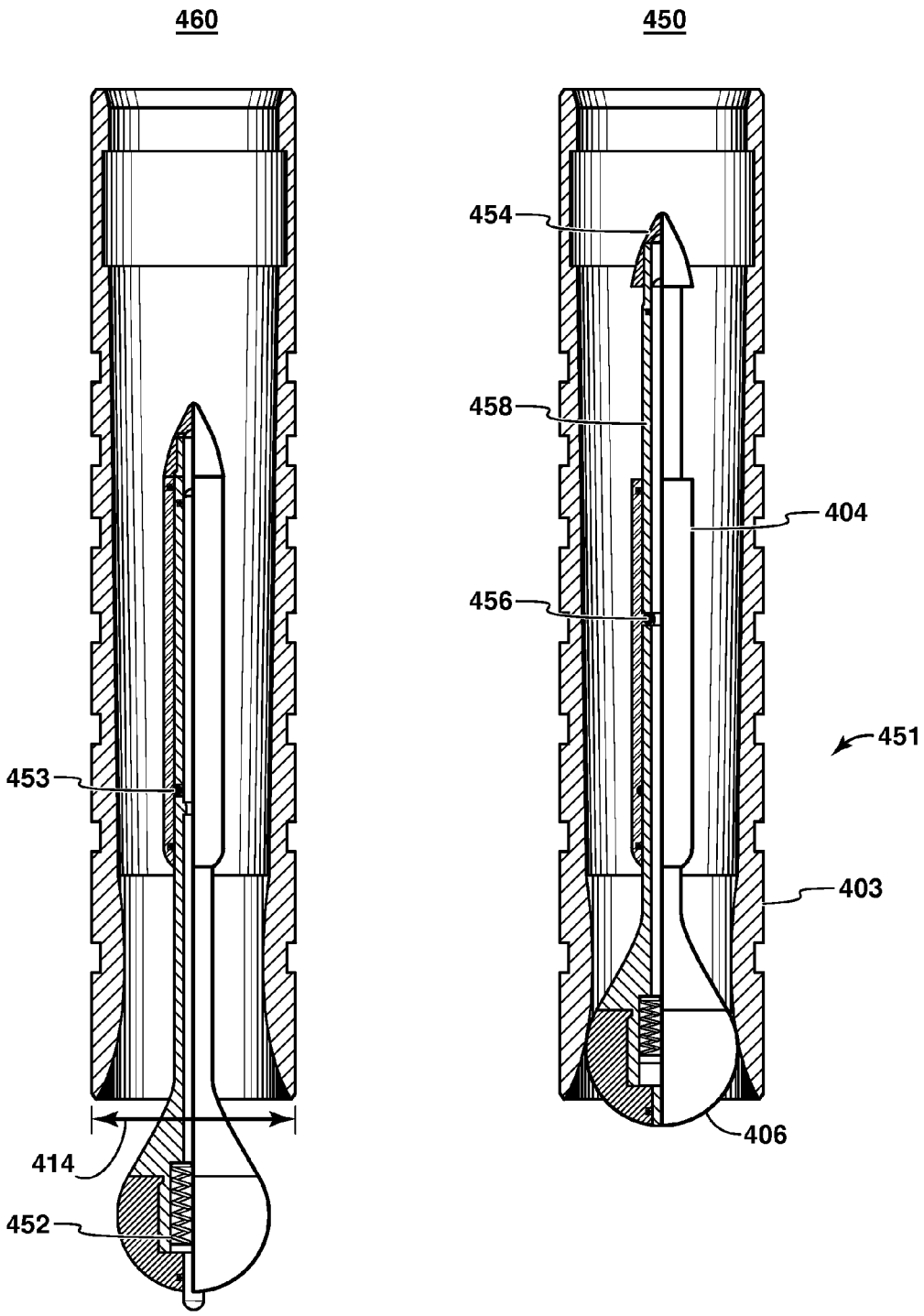
Figure 4C:
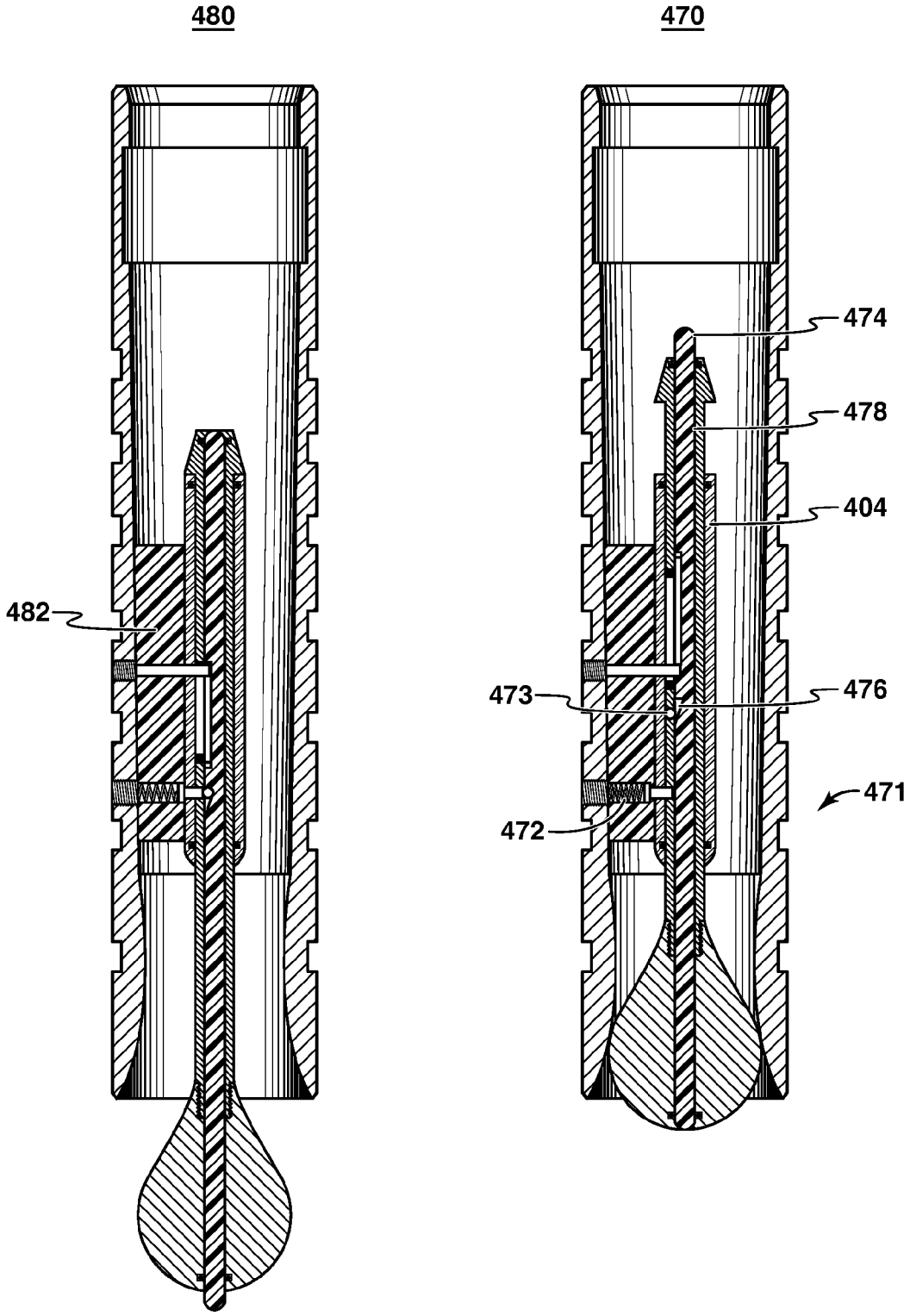
Figure 4D:
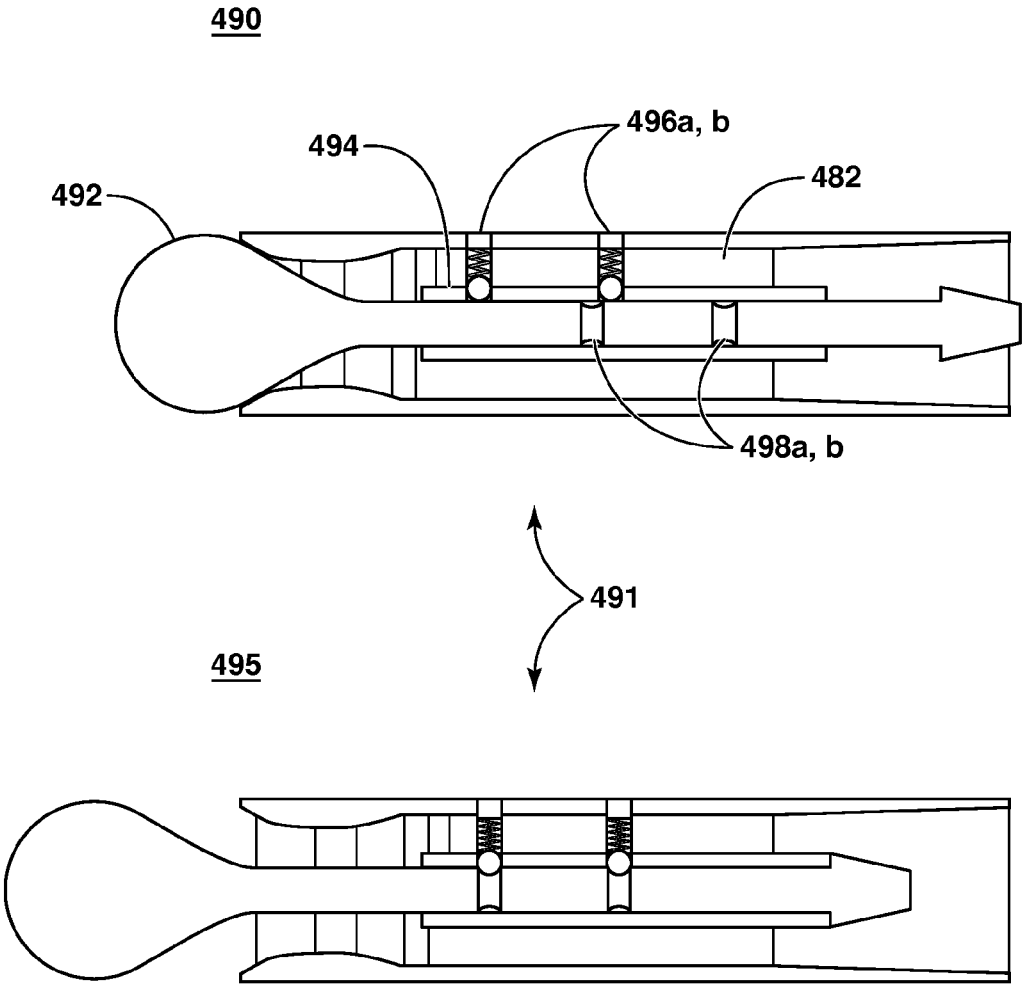

FIGS. 4A-4D show longitudinal-cut, cross-sectional views of four exemplary one-piece plunger apparatuses of FIGS. 1C-1D, including the internal locking mechanisms of the plungers. As such, FIGS. 4A-4D may be best understood with reference to FIGS. 1C-1D. In particular, FIGS. 4A-4C show exemplary embodiments of plunger configurations having a profile 140 and two-stage locking mechanisms. FIG. 4D shows an exemplary embodiment of a plunger configuration having a profile 160 and a one-stage locking mechanism. FIG. 4A shows a longitudinal-cut, cross-sectional view of an exemplary one-piece plunger apparatus. View 400 shows a plunger 402 in the closed configuration and view 420 shows the plunger 402 in the open configuration. The plunger 402 includes a cylindrical body 403, a center cylinder 404, a plug (and stem) mechanism 406, an actuation member 407 having a first end 408 and a second end 410, and a locking apparatus having balls 416*a* to engage the body of the actuation member, grooves 416*b* to engage the balls, and a spring and ball arrangement 416*c* to engage the actuation member 407 near the second end 410. View 420 additionally shows an opening 414 of a flow channel 415, a plurality of turbulent sealers 418, and a fishing neck 419.

In one illustrative embodiment, the plunger 402 includes a plug mechanism 406 (or plug-type valve element) including an elliptical or streamlined ball on a rod stem. The plug mechanism 406 is configured to cyclically close and open the flow channel 415 during operation. When the plug mechanism 406 closes, the interior of a well conduit (tubing) is sealed so that the liquid in the well above the plunger 402 is prevented from falling through the plunger 402 during ascent. In this manner, liquid can be lifted to the surface by the means of the gas pressure build-up in a well. When the plug mechanism 406 opens the plunger 402 can easily fall through the wellbore fluid (be it gas, water, other liquids, or combinations) down to the bottom of the well.

Beneficially, the shape of the plug mechanism 406 and the inside profile of the plunger cylinder 403 are configured to mitigate the effects of hydrodynamic drag forces ("fluid-dynamically optimized") generated by the internal flow as the plunger 402 falls against high rate upwards gas and/or liquid flows. The shape of each element of the plunger 402, including, but not limited to, the ball valve 406, the valve stem housing 405, and the plunger body 403 are carefully designed to reduce or mitigate such flow friction and to enhance the descending velocity of the plunger 402 against high rate fluid flows, while maintaining other plunger functionality such as sealing the produced gases from the water, repeatability of operation, and resistance to mechanical failure, as discussed above. As such, the plunger 402 can descend at an acceptable velocity even against high rate gas and liquid flows, thus making the plunger 402 applicable to high rate gas wells (e.g. over about 200 kscf/d).

Another illustrated aspect of the present disclosure includes the center cylindrical part 405 configured to hold the plug mechanism 406 and guide the valve stem portion of the plug mechanism 406. Advantageously, the ball plug 406 is aligned with the center line of plunger 402.

Still another exemplary aspect of the present disclosure is represented by the two-stage locking mechanism 407, and 416*a*-416*c*. One function of the locking mechanism is to ensure that the plug and valve element 406 remains in the desired position during plunger operations. The locking mechanism 407, and 416*a*-416*c* prevents the plug element 406 from undesirably engaging when the plunger 402 splashes at a high descending speed into continuous water or a water slug. On the other hand, the locking mechanism 407, and 416*a*-416*c* can be unlocked by a small continuous force when the plunger 402 reaches a subsurface bumper spring at the bottom of the well. Such an arrangement beneficially allows the plunger 402 to have "automatic" actuation between the open and closed positions, rather than requiring external controls or signals to open or close the plunger. However, automatic operation of the plunger 402 does not require the elimination of control devices and may be used with control devices for certain circumstances (e.g. optimization of plunger lift operation). Note that the balls 416*a* and spring 416*c* locking elements are only one exemplary embodiment that may be used in the presently disclosed plunger 402. Other locking mechanisms may include magnetic latching means, compression ring engagement means, or some other equivalent arrangement known by persons of ordinary skill in the art.

In particular, the locking mechanism 407, and 416*a*-416*c* of plunger 402 comprises grooves 416*b* on both the actuation member 407 and center cylinder 404. There are two perforated grooves or holes (retaining the bearing balls 416*a*) on the inner cylinder of the plug mechanism 406, perpendicular to the axis, phasing 180 degrees, and crossing the center. The holes, together with the grooves 416*b* form a housing for the balls 416*a*. The balls 416*a* can move outwards or inwards depending on the force direction and availability of space (e.g. groove). If there is not space for the ball to move into, either outwards to the outmost cylinder 405 of the center body or inwards to the actuation member 407, then the ball 416*a* will lock the two pieces together that host the balls.

The actuation member 407 plays an important role for the locking mechanism. The mechanism is designed to lock the plug valve 406 in the outer center body 404 when the plunger descends against upwards fluid flow. When the actuation member 407 is at its lower most position, the groove 416*b* on the rod is away from the balls so that the mechanism is locked.

When the plunger 402 reaches the bottom of a well, the actuation member 407 touches the bumper head at a bottom bumper spring assembly and stops moving first while all other components of the plunger 402 continue descending under the gravity force. When the plug mechanism 406 is stopped by the bottom bumper spring, the actuation member 407 is pushed into the plug mechanism 406 so that the groove 416*b* on the actuation member 407 is facing the balls 416*a*. Since a space is opened for the balls 416*a* to move into, the mechanism is unlocked. As the result, the cylindrical body 403 and the center cylinder 404 are allowed to continue descending until the cylindrical body 403 contacts the plug 406 so that the plunger opening 414 is closed. Then, wellbore flow and pressure will push the plunger 402 and a water column upward to a surface.

When the plunger 402 is closed and travels upwards, the locking mechanism is ineffective because the differential pressure across the plunger 402 will keep the plunger plug valve 406 closed until the plunger 402 reaches the surface. When the plunger 402 reaches the surface, an extension rod on a wellhead assembly will knock the plug valve 406 open and push the balls 416*a* into the groove 416*b* on the center cylinder 404 so that the plunger 402 is locked open. As the result, the plunger 402 will descend in the wellbore starting a new tripping cycle.

One optional aspect of the present disclosure is represented by the internal fishing neck 419 on the inner profile of the tubular cylindrical plunger body 403. The fishing neck 419 can be used for retrieving the plunger 402 in the well in case of plunger failure.

Note that the plunger 402 may further include O-ring seals on both ends of each element that experiences relative movement (e.g. 404, 406, and 407). These seals are designed to prevent solids and debris such as formation sands or fine particles from entering the locking mechanism and thus endangering the functionality of the plunger.

Further note that there is also a support element connecting the cylinder body 403 and the center cylinder 404. This element is not shown in FIG. 4A, but a similar element is shown in FIG. 4C.

FIGS. 4B-4C show three longitudinal-cut, cross-sectional views of two alternative embodiments of the one-piece plunger apparatus of FIG. 4A including two-stage locking mechanisms. As such, FIGS. 4B-4C may be best understood with reference to FIG. 4A. FIG. 4B shows alternative plunger 451 in a closed view 450 and an open view 460. The plunger 451 generally includes the same features as the plunger embodiment 402, but illustrates an alternative locking mechanism 452-453, and 456, and an inner insertion rod 458 with an end-cap 454 integrated therewith.

In the embodiment of FIG. 4B, plunger 451 illustrates another locking mechanism. Plunger 451 utilizes a compression spring 452 directly against the impact force on the rod 458 when the plunger 451 splashes into a water slug or column. For each of the plungers 402 and 451, the springs 416*c* and 452 have a spring rate configured to actuate the inner insertion rods 407 and 458 (e.g. the plug mechanism 406 will move to the closed position) when the plunger 402 or 451 touches a solid surface. Because plunger 451 uses a compression spring 452 to keep the inner rod 458 extended, this design does not rely on other forces, such as impact force, to return the rod 458 to the locked (open) position.

FIG. 4C shows alternative plunger 471 in a closed view 470 and an open view 480. The plunger 471 generally includes the same features as the plunger embodiments 402 and 451, but illustrates an alternative locking mechanism 472-473, and 476 housed in a support element 482 and an inner insertion rod 478 with an end-cap 474 integrated with a downstream portion of the stem portion of the plug mechanism 406. The locking mechanism includes an inner insertion rod 478 with an end-cap 474, spring 472 and ball 473 elements interoperable with the inner insertion rod 478 and a groove element 476 to form a locking apparatus.

FIG. 4D shows an embodiment of the one-piece profile 160 with an exemplary one-stage locking mechanism. As such, FIG. 4D may be best understood with reference to FIGS. 1D and 4A-4C. In particular, plunger configuration 491 in view 490 shows the plunger 402 in the closed position and view 495 with plunger 402 in the open position. The plunger 402 includes a support member 482, a center cylinder 494, a plug or valve mechanism 492 having an end or head portion with a streamlined shape and a one-stage locking mechanism comprising two spring-loaded latches 496A and 496B with balls and two annular grooves 498A and 498B for receiving the balls in the locked or open position.

The one-stage locking mechanism 496A-496B and 498A-498B is configured to impart a force on the plug mechanism 492 in the open position sufficient to maintain the plug mechanism in the open position as the plunger apparatus 491 falls through continuous water. In the closed position 495, the locking mechanism does not hold the plug mechanism 492 in place. Instead, the pressure from produced fluids (e.g. gas and some water) will force the plug mechanism into the plunger body to maintain the closed position as the plunger 491 trips up to the top of the wellbore. Beneficially, the one-stage locking mechanism does not require an actuation member 144 or 407 and may be easier to manufacture and more robust in operation than the two-stage locking mechanisms disclosed in FIGS. 4A-4C.

Yet another exemplary aspect of the present disclosure comprises the support or fin element 482, which may be configured to fasten to the center element 404 and house the locking mechanism 472-473. No particular requirement is given for the number of support elements 482, but minimal drag is desired.

Figure 4E:
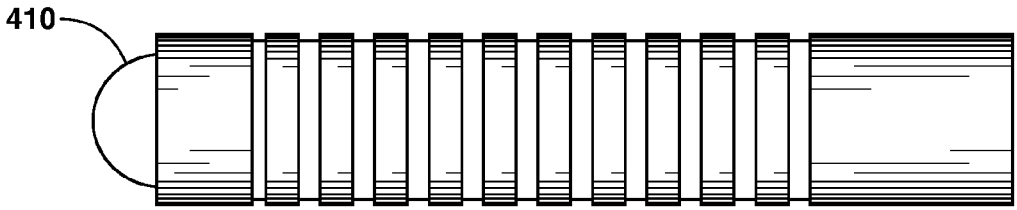
FIGS. 4E-4F show illustrative external views of the exemplary one-piece plunger apparatus of FIGS. 4A-4D.
Figure 4E:
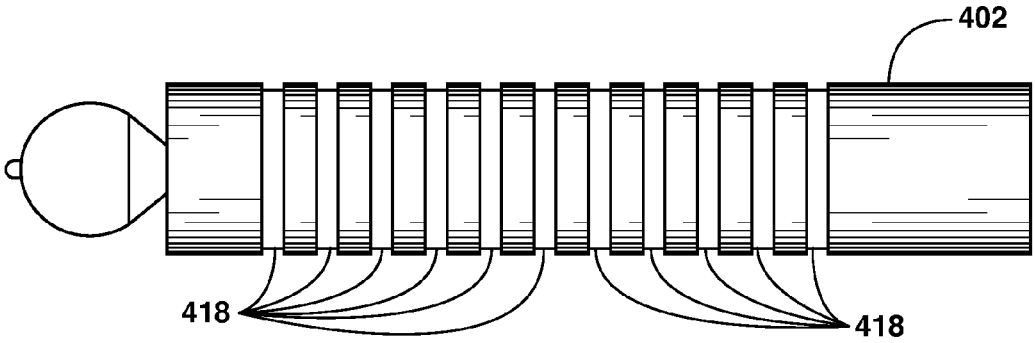
Figure 4F:
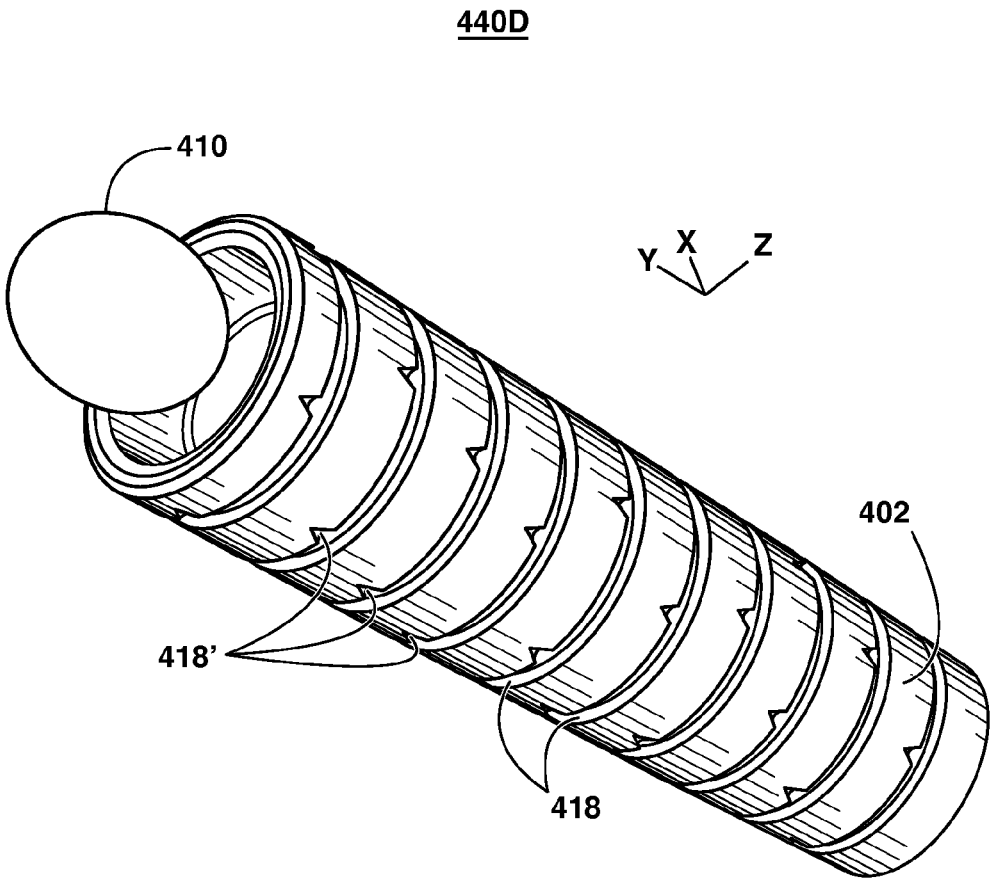

FIGS. 4E-4F show external views of the exemplary one-piece plunger of FIGS. 4A-4D. As such, FIGS. 4E-4F may be best understood with reference to FIGS. 4A-4D. View 400D shows the open position of the plunger 402 (which may also be plunger 451 or 471), while view 420D shows the closed position. Note that the depicted sealing mechanisms 418 on the outer perimeter of the plunger 402 are standard turbulent sealers, but may be any one of a pad plunger type, brush type, or wobble-washer type. View 440D shows the plunger 402 in the open position and further shows sealing mechanisms 418' configured to induce an azimuthal variation of the toroidal vortex of a turbulent sealer, as discussed above.

In the exemplary embodiment 440D, the side-wall or outer wall may includes sealing mechanisms 418' having a fluid sealing element in the cavity of the sealing mechanism configured to induce an azimuthal variation of the toroidal vortex (e.g. "3-D vortex generator"). The 3-D vortex generator may be understood as a "sharp" edge in a fluid flow cavity (e.g. the sealing mechanism 418') configured to disrupt the axial-symmetry of the cavity such that the 3-D vortex generator creates a complex vortical structure when fluid flows over or through the 3-D vortex generator. Examples of a 3-D vortex generator include a small cut 418' in the front edge of a turbulent sealer 418 (as shown in FIG. 4E), an angular sealing mechanism 418 (making a cavity that looks like a "V"), and a sealing mechanism 418 with a sharp step therein. In addition, it is preferred that the fluid sealing element of one sealing mechanism (or cavity) is axially mis-aligned with a fluid sealing element of an adjacent sealing mechanism, as shown.

Beneficially, the improved sealing mechanisms 418' are configured to reduce or minimize both the downward flow of water and the upward flow of gas in the space between the outer surface of the plunger cylinder 403 and the tubing walls. This not only reduces the leak of lifted water during the ascent, but also maintains the gas pressure underneath the plunger 402, thus increasing the overall efficiency of the system. These sealing mechanisms are further described and disclosed in commonly assigned U.S. Provisional Patent Application Nos. 61/222,788 and 61/239,320 entitled "FLUID SEALING ELEMENTS AND RELATED METHODS" and filed on 2 Jul. 2009 and 2 Sep. 2009, respectively. Each of these applications are incorporated herein by reference in their entirety for all purposes, except the portions dealing with devices other than plungers.

It should be noted that the sealing mechanisms 418' are configured to provide a continuous interface between a liquid and a pressurized gas when the plunger 402 ascends in a well with the plug mechanism 406 in the closed position. Additionally, the sealing mechanisms 418 may be slightly smaller than a diameter of a well tubing to account for irregularities and/or paraffin, wax, salt, or other buildup on the inside of the tubing walls. As discussed above, the outer diameter of the plunger body, with or without the sealing mechanisms 418, may be slightly less than the diameter of the tubing string in which the plunger is intended to travel. Other exemplary side-wall geometries include, for example, wobblewashers (e.g. variable or shifting ring side-wall), a brush-type side-wall, an expanding blade assembly (e.g. spring-loaded interlocking pads), or any combination thereof. These geometries and their capabilities and limitations are well-known to those of skill in the art and may be found, for example in U.S. Pat. No. 7,383,878, the portions of which dealing with side-wall geometries are hereby incorporated by reference.

In another embodiment of the plungers 402, 451, 471, or 491 disclosed herein, a friction reducing coating (FRC) may be applied to some portion or all of the portions of the plunger, which may be exposed to dynamic fluid forces and which it is desired to reduce such forces. For example, such a coating may be applied to the ball or plug portion of the plug mechanism 406, the leading or front edge of the plunger body 403, the extended second end of the actuation member 410, the outer surface of the plunger (including sealers 418), or any other exposed portion. Further, it is desirable that the locking mechanism have increased durability. As discussed, the conditions of the plunger operation also require durability and resistance to wear, so such a coating or surface must also be hard and durable.

Examples of potentially viable coating or materials options for a FRC include diamond-like carbon (DLC), advanced ceramics (e.g. TiN, $TiB_2$), near-frictionless carbon (NFC), TEFLON™, graphite, chemical-vapor deposition (CVD) diamond, and other such surface coatings.

Figure 5A:
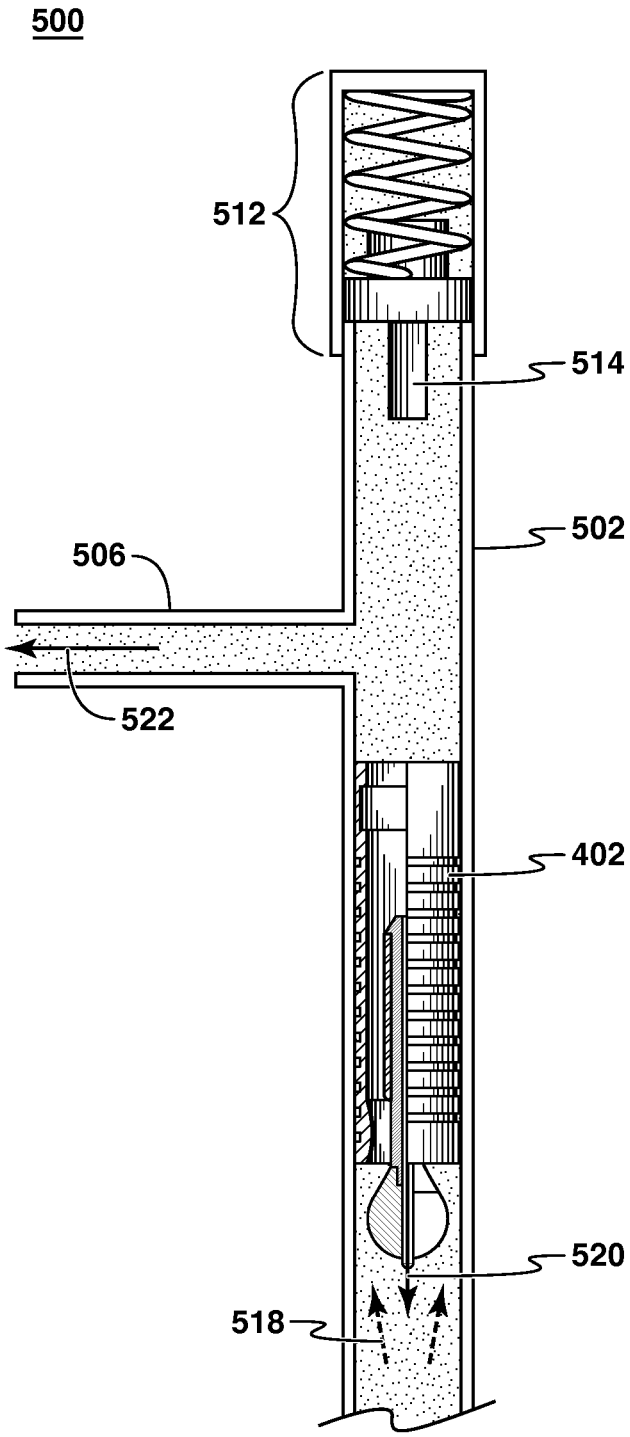
FIGS. 5A-5D illustrate a series of schematics showing a single cycle of the automatic plunger lift process utilizing the plunger of any one of FIGS. 4A-4E.

FIGS. 5A-5D illustrate a series of schematics showing a single cycle of the automatic plunger lift process utilizing the plunger of FIGS. 4A-4D. As such, FIGS. 5A-5C may be best understood with reference to FIGS. 4A-4D. FIG. 5A illustrates a view 500 showing a top portion of a wellbore tubing 502, a wellhead assembly 512 (including a cap, a bumper spring, a striker pad), an extension rod 514, an exemplary plunger 402, and a production flow line or pipe 506. The view 500 also includes arrows showing the direction of travel 520 of the plunger 402, direction of travel of gas 518 through the flow channel 415 and the tubing 502, and the direction of travel of gas 522 through the production pipe 506. Note that other common components on the wellhead (e.g. lubricator, valves, etc.) are not explicitly illustrated, but a person of ordinary skill in the art will understand how to implement such devices based on the disclosure herein.

Figure 5B:
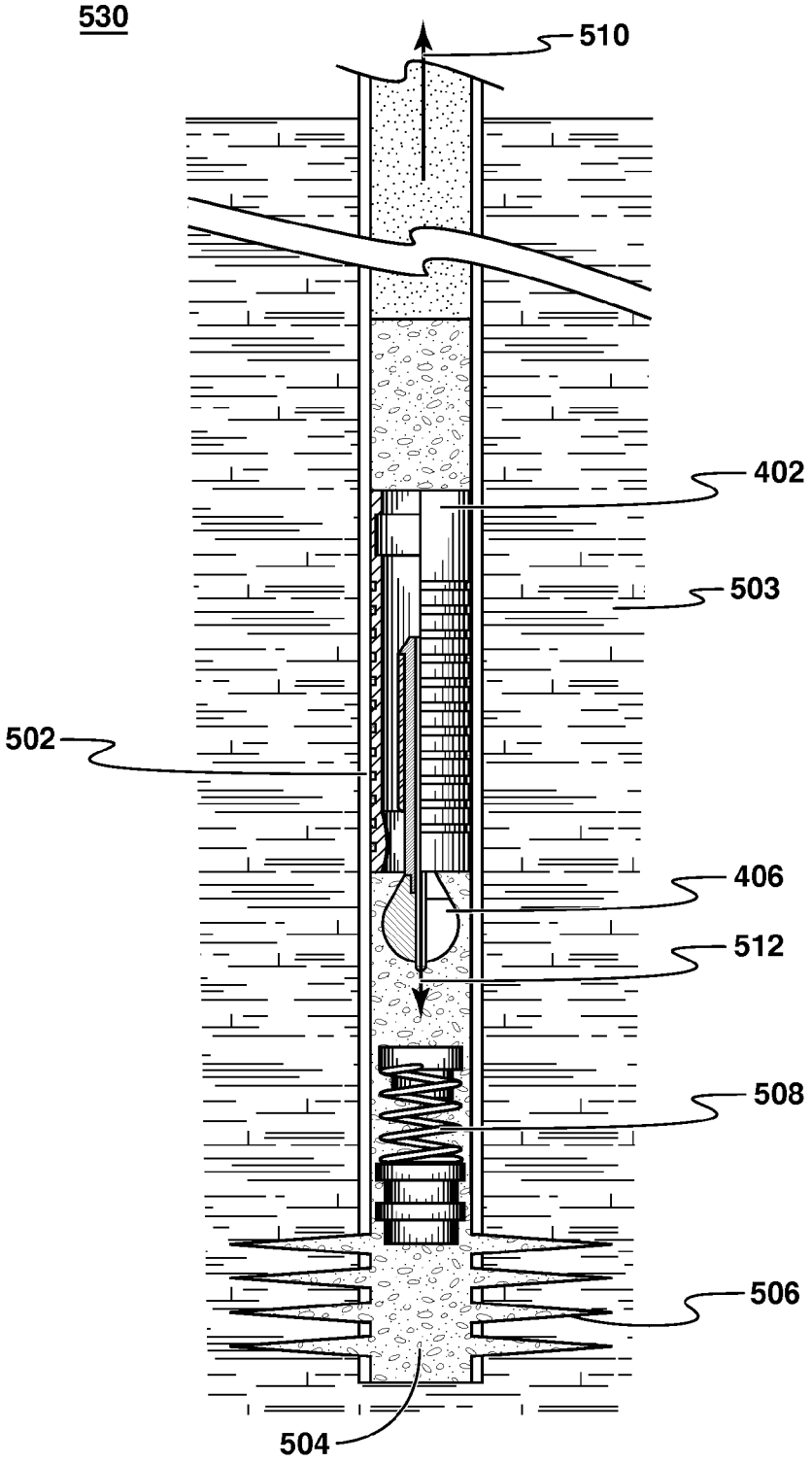

FIG. 5B illustrates the case where the plunger 402 is descending while the well 503 is producing water and gas 504 via perforations 506. The well 503 further includes a bumper spring assembly 508. Arrow 510 shows the direction of gas flow and arrow 512 shows the direction of plunger descent. Since the plug valve 406 is open, produced fluids can pass through the plunger 402. When the drag force due to fluid flow (gas and produced liquids) on the plunger 402 is not large enough to balance the plunger force of gravity, the plunger 402 will descend against the wellbore producing fluid flows.

Figure 5C:
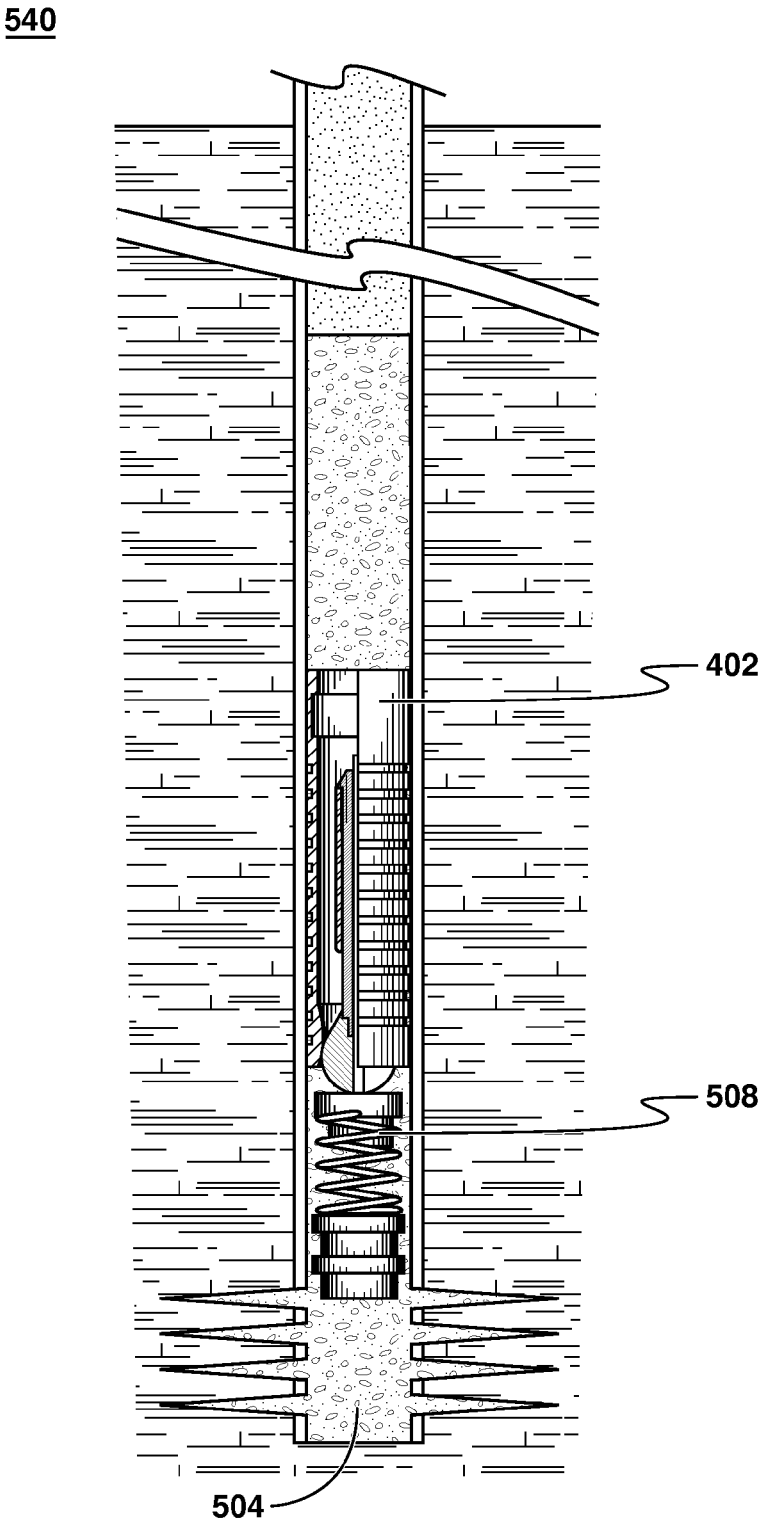

FIG. 5C illustrates the condition where the plunger 402 is stopped by the subsurface bumper spring 508 and the plunger 402 is in closed state and ready for tripping up (e.g. return to the surface).

Figure 5D:
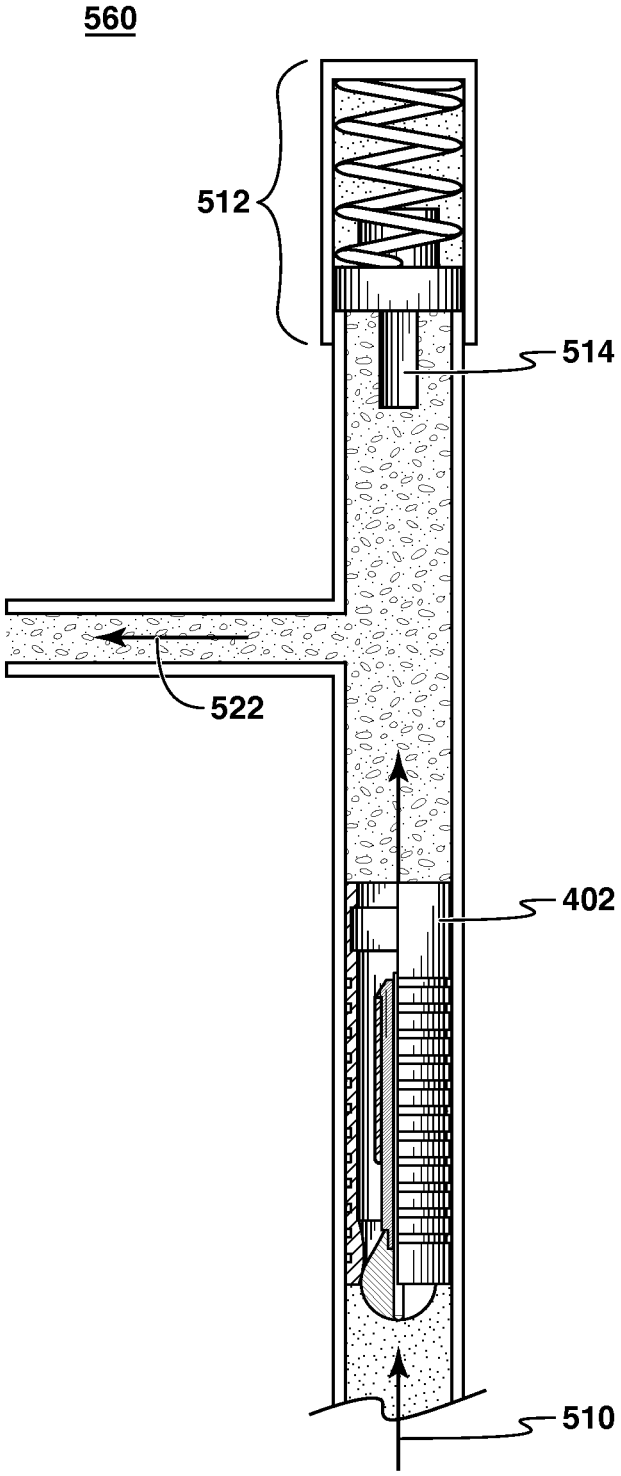

FIG. 5D illustrates the plunger 402 being pushed by the wellbore (gas) pressure up the well as indicated by arrow 510 to the surface near the wellhead assembly 512 and extension rod 514 while the water is being pushed into the production flow line 506 as shown by arrow 522.

Figure 6A:
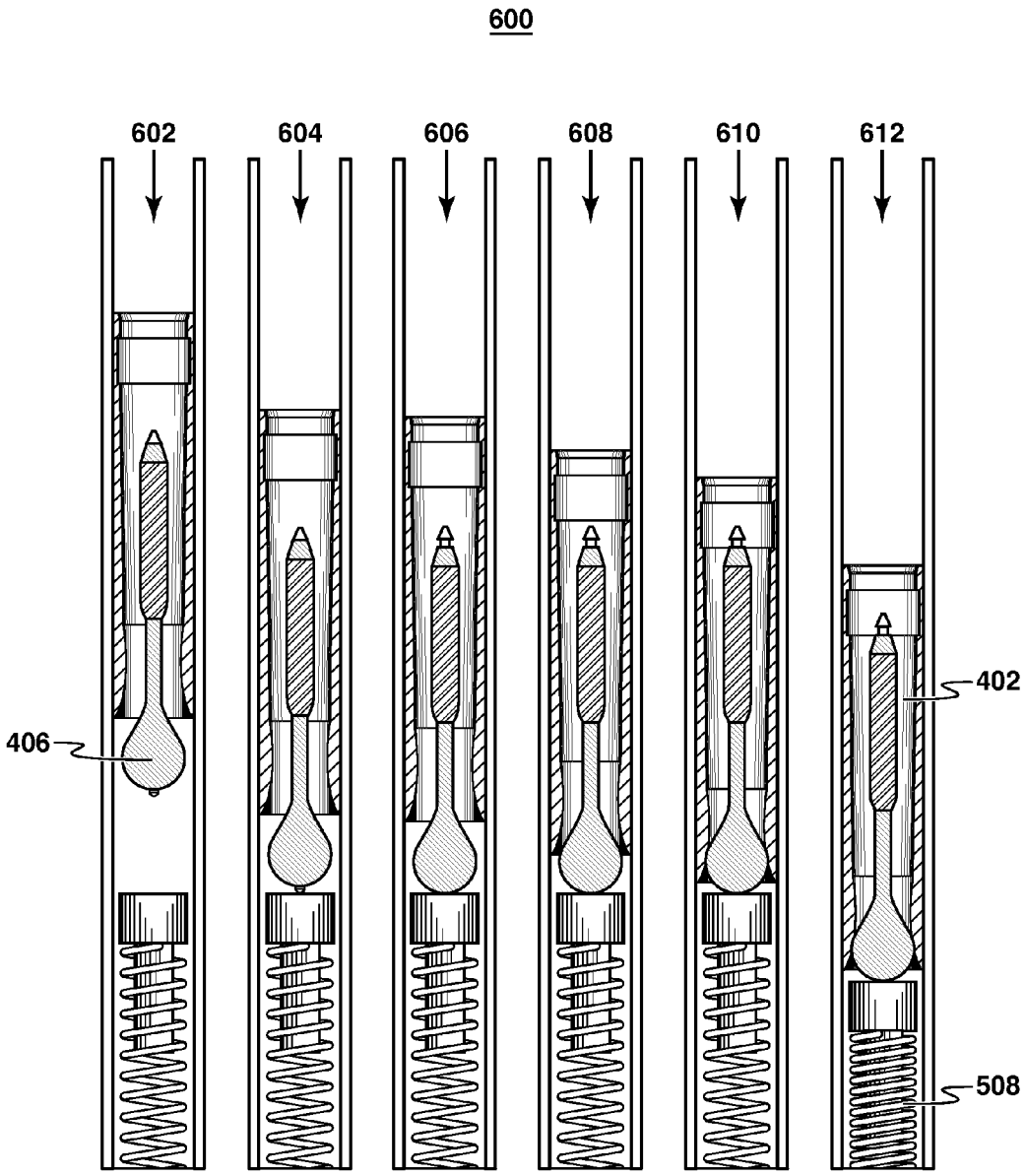
FIGS. 6A-6B illustrate the stages of the automatic plunger of FIGS. 4A-4E being closed by the impact at the subsurface bumper spring of FIGS. 5B and 5C.
Figure 6B:
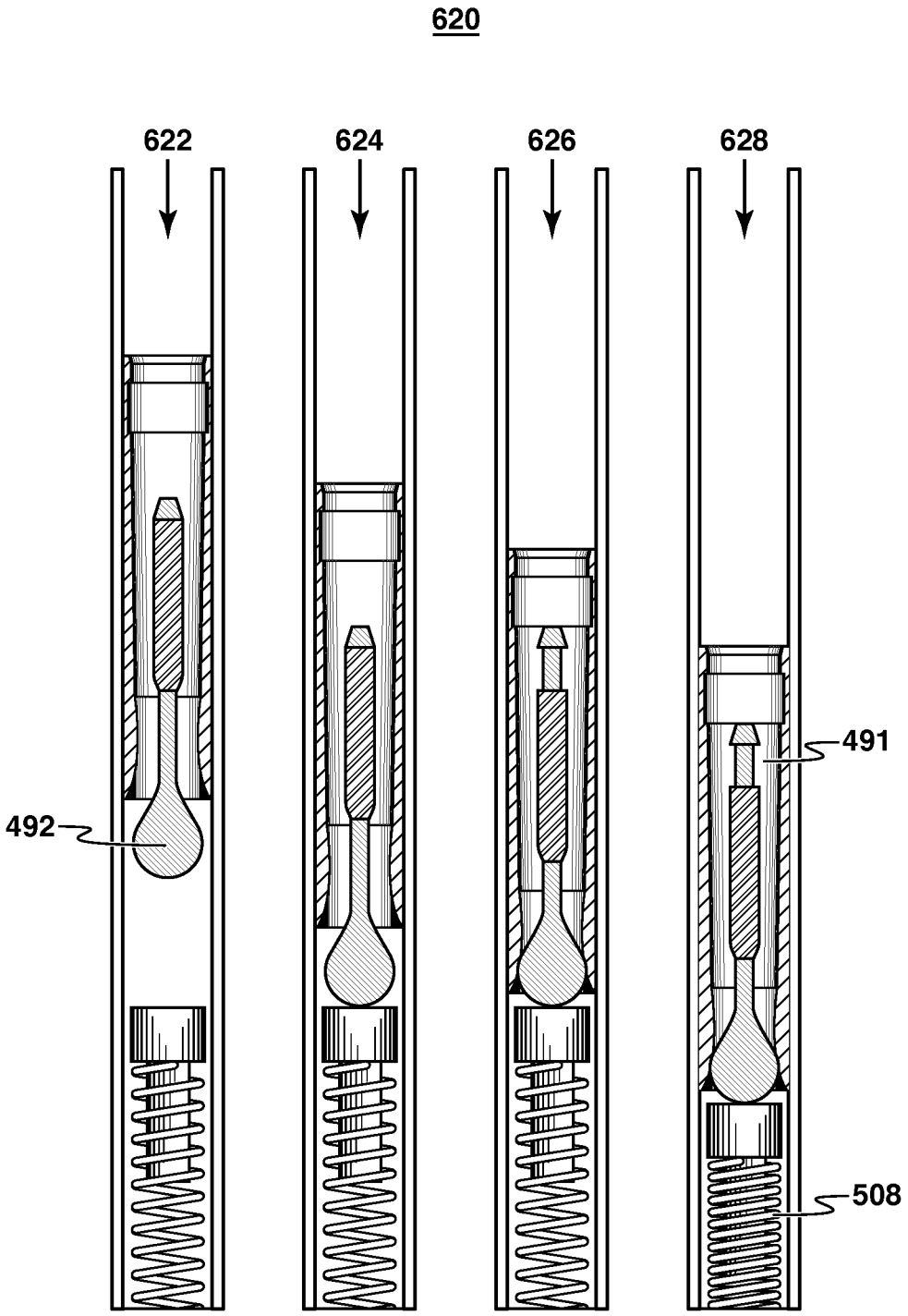

FIGS. 6A-6B illustrate the stages of the automatic plunger of FIGS. 4A-4F being closed by the impact at the subsurface bumper spring of FIGS. 5B and 5C. As such, FIGS. 6A-6B may be best understood with reference to FIGS. 4A-4F, 5B and 5C. The illustration 600, in schematic 602 shows the descending plunger 402 is approaching the subsurface bumper spring assembly 508. Schematic 604 shows the moment that the plunger 402 reaches the bumper spring assembly 508 and the insertion rod 407 of the plunger locking mechanism contacts the plunger stopper on top of the bumper spring assembly. Schematic 606 shows the insertion rod 407 as it is pushed into the plug or valve mechanism 406 and the plunger valve element is unlocked. Schematic 608 shows the valve mechanism 406 is pushed up while the plunger body 403 continues to descend. Schematic 610 shows the moment when the cylindrical plunger body 403 contacts and sits on top of the plug or valve mechanism 406 such that the plunger opening 414 is closed. Schematic 612 shows that as the momentum of descending plunger 402 tends to drive the plunger to move downwards, the subsurface bumper spring in assembly 508 is compressed until the plunger totally stops its descent.

In FIG. 6B, the illustration 620 in schematic 622 shows the descending plunger 491 is approaching the subsurface bumper spring assembly 508. Schematic 624 shows the moment that the plunger 491 reaches the bumper spring assembly 508. Schematic 626 shows the valve mechanism 492 is stopped while the plunger body 403 continues to descend until the moment when the cylindrical plunger body 403 contacts and sits on top of the plug or valve mechanism 492 such that the plunger opening 414 is closed. Schematic 628 shows that as the momentum of descending plunger 491 tends to drive the plunger to move downwards, the subsurface bumper spring in assembly 508 is compressed until the plunger totally stops its descent.

Figure 7A:
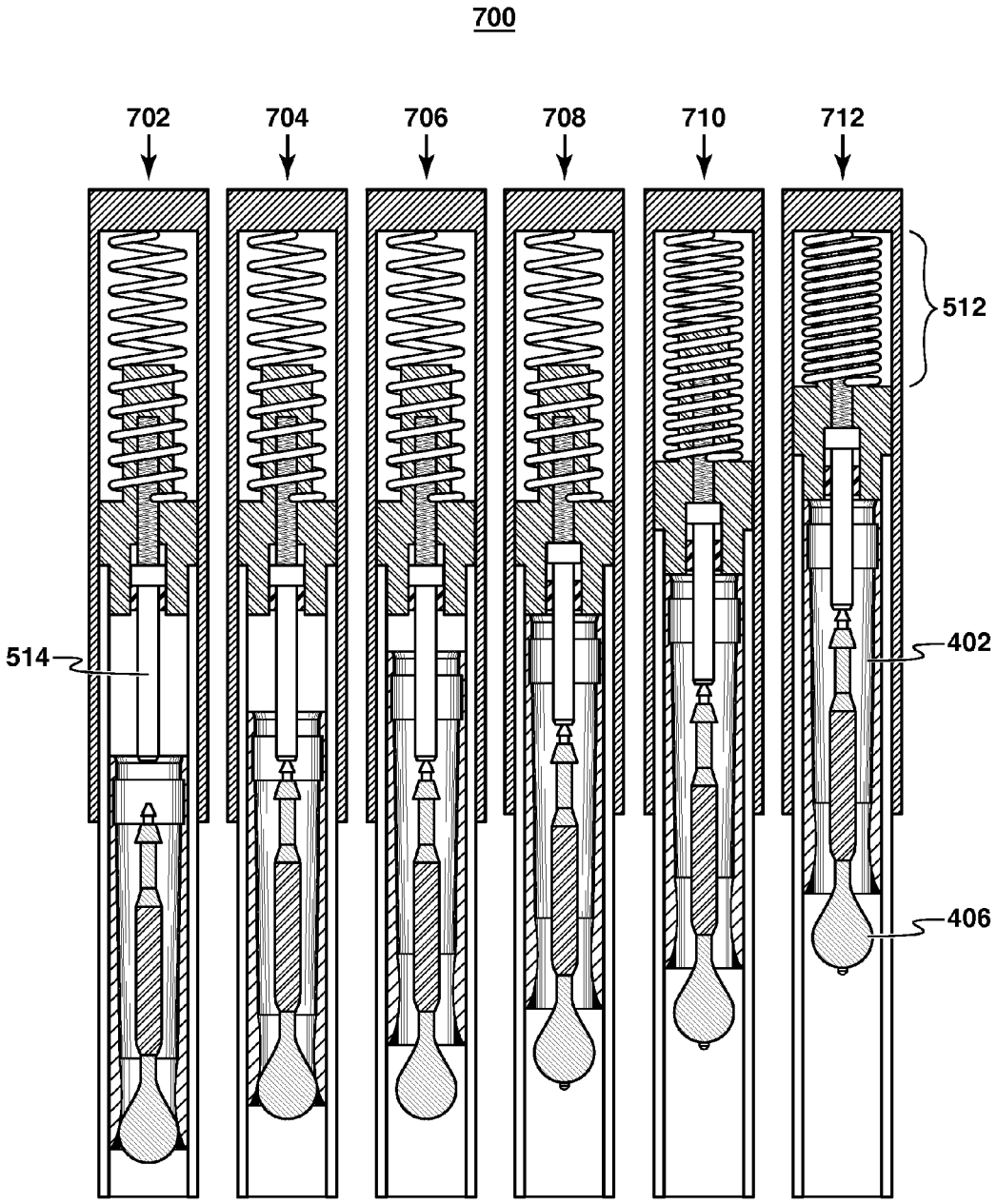
FIGS. 7A-7B illustrate the stages of the plungers of FIGS. 4A-4E being closed by the impact at the wellhead assembly of FIGS. 5A and 5D.
Figure 7B:
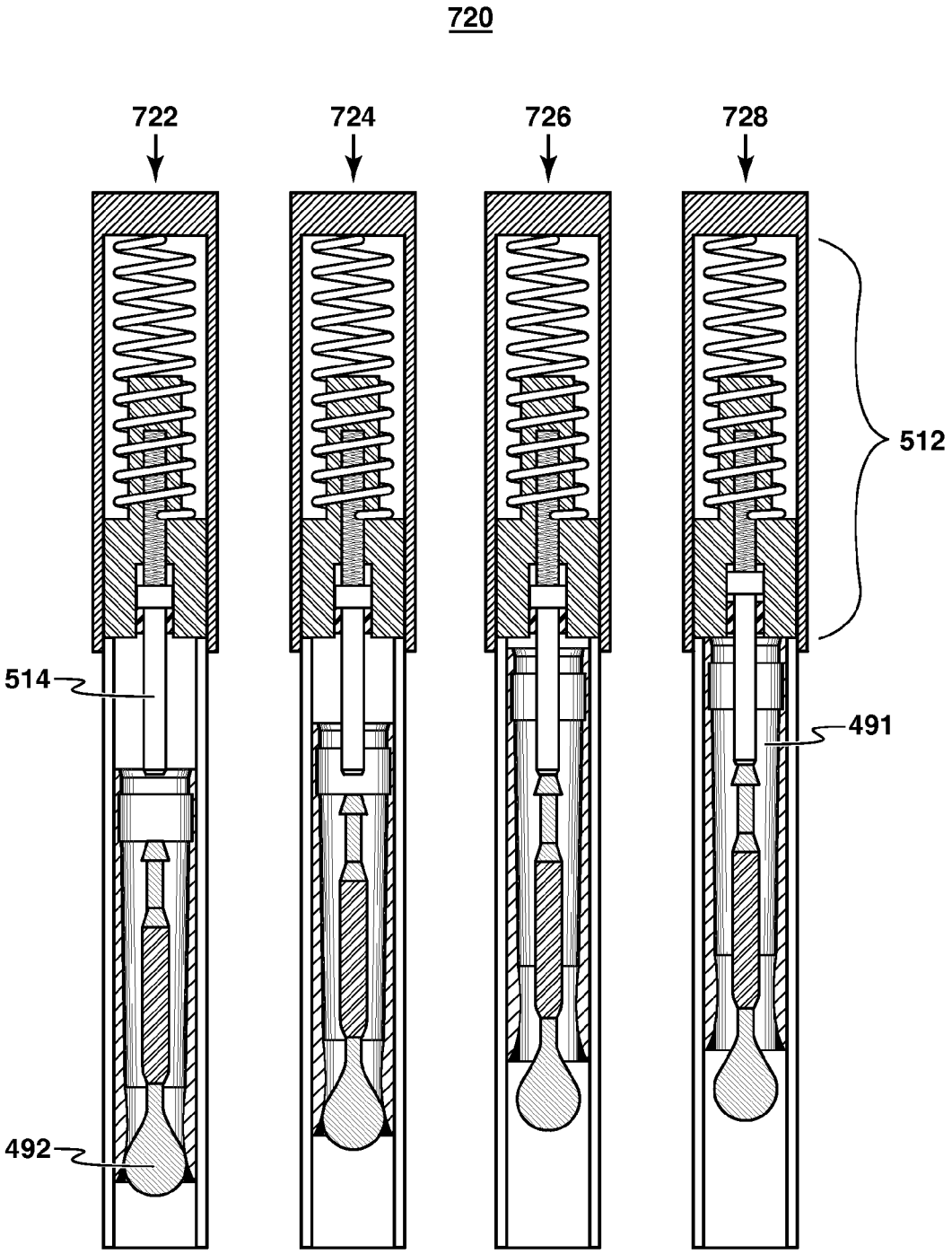

FIGS. 7A-7B illustrate the stages of the automatic plunger of FIGS. 4A-4F being closed by the impact at the wellhead assembly of FIGS. 5A and 5D. As such, FIGS. 7A-7B may be best understood with reference to FIGS. 4A-4F, 5A, and 5D. View 700 shows schematic 702 illustrating the plunger 402 being pushed by wellbore gas pressure and approaching the wellhead stopper assembly 512. Schematic 704 shows that the plunger insertion rod 407 contacts the extension rod 514 of the plunger stopper assembly 512. Schematic 706 shows that as the insertion rod 407 is stopped by the wellhead assembly 512, the stem of the valve element 406 moves up, contacts the step end of the insertion rod 407, and stops moving. Schematic 706 further shows the plunger body 403 continuing to move upwards from the momentum of the plunger 402. Schematic 708 shows that the valve element 406 is locked in its open position as it is pushed into place by the extension rod 407. The momentum continues to carry the plunger 402 up in schematic 710. As the stopper 512 absorbs all the kinetic energy of the plunger 402, the plunger velocity is finally reduced to zero in schematic 712. At this moment, the plunger 402 is ready to fall to start a next tripping cycle.

In FIG. 7B, view 720 shows schematic 722 illustrating the plunger 491 being pushed by wellbore gas pressure and approaching the wellhead stopper assembly 512. Schematic 724 shows the plunger 491 closer to the wellhead stopper assembly 512. Schematic 726 shows that the second end of the plug assembly 492 contacts the extension rod 514 of the plunger stopper assembly 512. Schematic 728 further shows the plunger body 403 continuing to move upwards from the momentum of the plunger 491 compressing the spring in the plunger stopper assembly 512. As the stopper 512 absorbs all the kinetic energy of the plunger 491, the plunger velocity is finally reduced to zero in schematic 728. At this moment, the plunger 491 is ready to fall to start a next tripping cycle (unless it is caught and held at the top of the wellbore).

Figure 8:
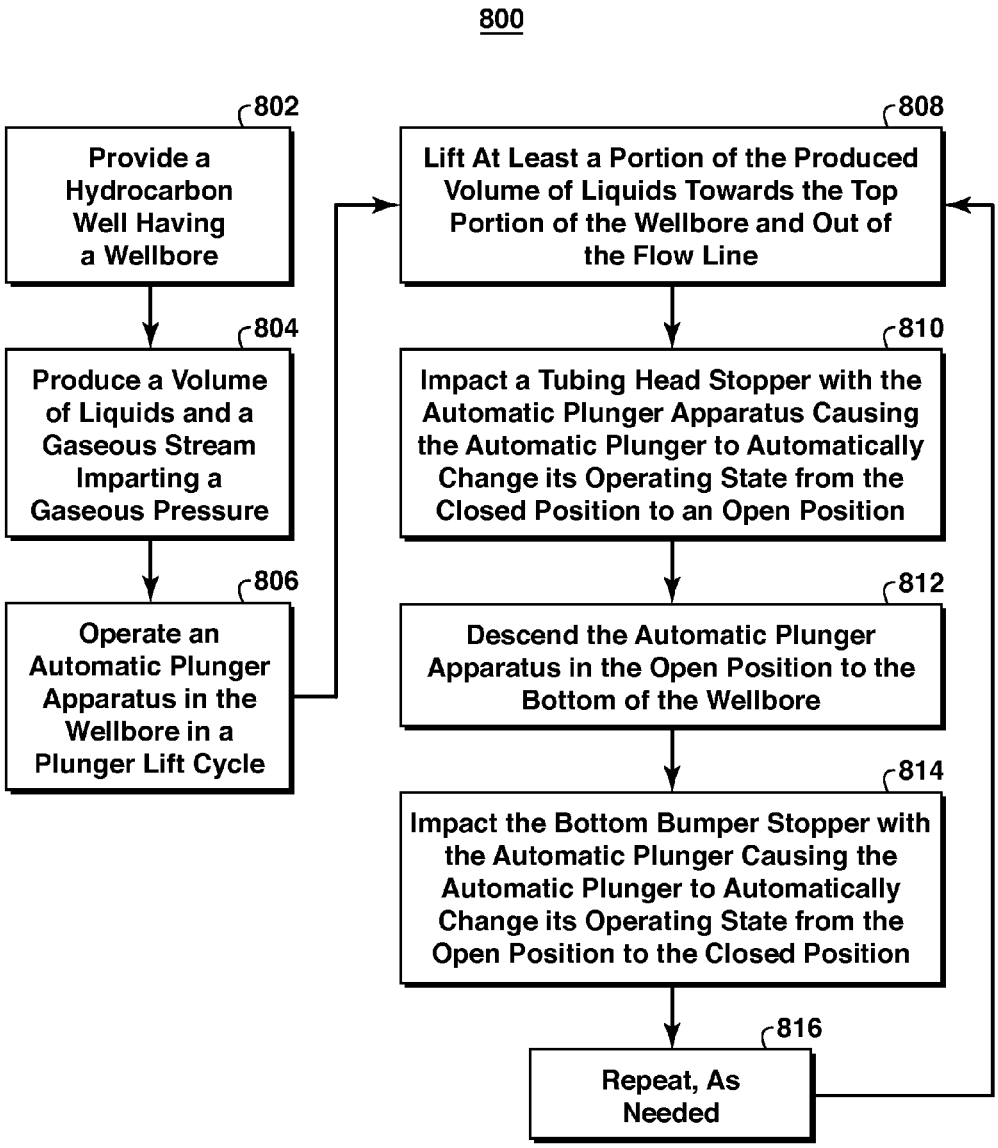
FIG. 8 illustrates a method of operating the plunger of FIGS. 4A-4E.

FIG. 8 illustrates a flow chart showing the steps of a method of producing hydrocarbons using the plunger of FIGS. 4A-4F in the cycle of FIGS. 5A-5D. As such, FIG. 8 may be best understood with reference to FIGS. 4A-4F and 5A-5D. The process 800 includes providing 802 a hydrocarbon well 503 having a wellbore tubing 502, a flow line 506 in fluid communication with the wellbore, a top portion 512 with a tubing head stopper, and a bottom portion with a bottom bumper stopper assembly 508. Next, producing 804 a volume of liquids and a gaseous stream 504 imparting a gaseous pressure from the bottom portion to the top portion of the wellbore 503. Then, operating 806 an automatic plunger 402 or 491 in the wellbore 503 in a plunger lift cycle, the lift cycle comprising: lifting 808 at least a portion of the produced volume of liquids 504 towards the top portion of the wellbore and out of the flow line 506 utilizing the gaseous pressure from the bottom portion to the top portion of the wellbore, wherein the automatic plunger 402 or 491 is in a closed position; impacting 810 the tubing head stopper 514 with the automatic plunger 402 or 491 causing the automatic plunger 402 or 491 to automatically change its operating state from the closed position to an open position; descending 812 the automatic plunger 402 or 491 in the open position to the bottom of the wellbore 503, wherein a gravitational force on the plunger 402 or 491 is greater than a combined drag force and pressure force on the plunger apparatus 402 or 491 caused by the passage of the volume of fluids and the gaseous stream; impacting 814 the bottom bumper stopper 508 with the automatic plunger 402 or 491 causing the automatic plunger 402 or 491 to automatically change its operating state from the open position to the closed position; and repeating 816 the artificial lift cycle.

Note that the disclosed method may be optimized, altered or improved in a variety of ways depending on the flow rate of the well, diameter of the well, composition of the fluids produced in the well, and other factors. One particular exemplary feature includes controlling the plunger lift cycle by catching the automatic plunger apparatus 402 or 491 at or near the top portion of the wellbore; holding the automatic plunger apparatus 402 or 491 for a period of time; and releasing the automatic plunger apparatus 402 or 491 upon the occurrence of a condition in the wellbore. One exemplary condition may be shut-in of the well for maintenance or safety reasons. Another exemplary condition may be that there is simply not much liquid loading in the well and therefore no need to immediately send the plunger to the bottom to bring up liquids.

Figure 9:
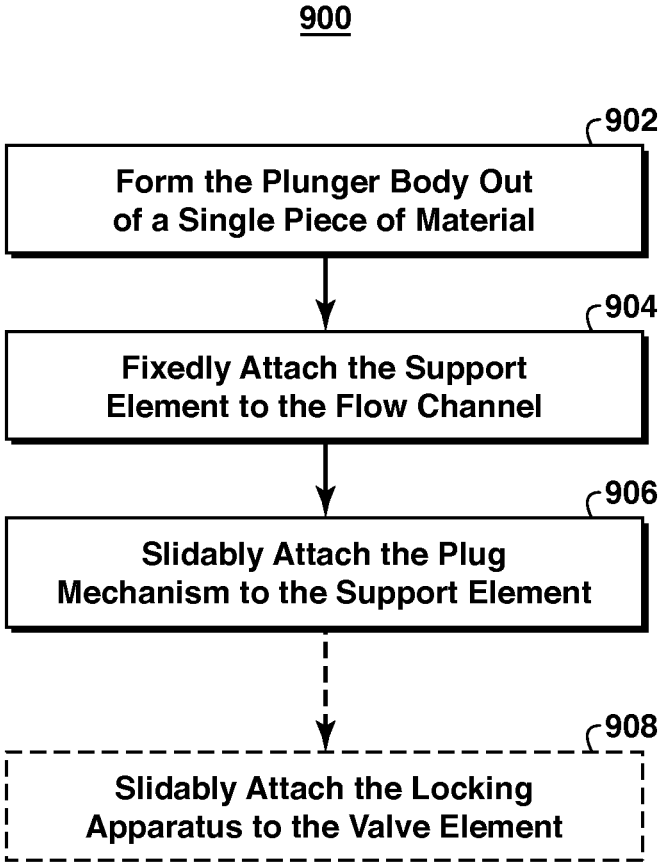
FIG. 9 illustrates a method of manufacturing the plunger of FIGS. 4A-4E.

FIG. 9 illustrates a method of manufacturing the plunger of FIGS. 4A-4F. As such, FIG. 9 may be best understood with reference to FIGS. 4A-4F. The method 900 includes forming 902 the plunger body 403 out of a single piece of material; fixedly attaching 904 the support element 404 to the flow channel 415; slidably attaching 906 the plug or valve element 406 to the support element 404; and optionally slidably attaching 908 the locking apparatus 407 to the valve element 406. In the case of the one-stage locking mechanism arrangement 491, there is no locking apparatus 407, so this step is not necessary.

The method may further include forming multiple turbulent sealers each having at least one vortex generator on an outer surface of the plunger body; and applying a friction reduced coating on at least a portion of the plunger, wherein the FRC is selected from the group consisting of: diamond-like carbon (DLC), advanced ceramics, graphite, and near-frictionless carbon (NFC). Any workable manufacturing technique may be applied, but it is contemplated that casting, welding, etching, and lathing techniques may be used alternatively or in combination to manufacture the disclosed plunger apparatus.

While the presently disclosed technology may be susceptible to various modifications and alternative forms, the exemplary embodiments discussed above have been shown only by way of example. However, it should be understood that the invention is not intended to be limited to the particular embodiments disclosed herein. Indeed, the presently disclosed inventions include all alternatives, modifications, and equivalents falling within the true spirit and scope of the invention as defined by the following appended claims.

What is claimed is:

1. A one-piece plunger apparatus, comprising:

a plunger body having a substantially annular cross-section and an outer diameter, wherein the outer diameter is slightly less than an inner diameter of a tubing string of a gas producing well, the plunger body able to travel within the tubing string;

a flow channel through the plunger body; and a plug mechanism physically integrated with the plunger body and having a closed position and an open position with respect to the plunger body and flow channel, the open position configured to permit the passage of a continuous water slug past the plug mechanism and through the flow channel, wherein the plug mechanism operatively extends from the plunger apparatus and comprises a substantially streamlined profile when the plug mechanism is operatively extended in the open position with respect to the plunger body and flow channel.

2. The apparatus of claim 1, wherein the plunger apparatus is configured to fall through the continuous water slug in the gas producing well at a falling velocity relative to the continuous water slug velocity greater than about (150+50×M) feet per minute (ft/min), where M is the mass in units of $lb_m$ of the plunger apparatus.

3. The apparatus of claim 1, further comprising an actuation member operatively engaged with the plug mechanism, extending outwardly from the plug mechanism, and having a surface area exposed to the continuous water in the gas producing well smaller than a surface area of the plug mechanism exposed to the continuous water in the gas producing well and the surface area exposed to the continuous water having a streamlined profile, wherein the plunger apparatus falls in the open position until the actuation member encounters a first actuation force causing the plug mechanism to automatically move to the closed position.

4. A two-piece plunger apparatus, comprising:

a plunger body having a substantially annular cross-section and an outer diameter, wherein the outer diameter is slightly less than an inner diameter of a tubing string of a gas producing well and the plunger body is able to travel within the tubing string;

a flow channel through the plunger body; and a plug mechanism releasably connected to the plunger body and having a closed (connected) position and an open (released) position with respect to the plunger body and flow channel, the open position configured to permit the passage of continuous water through the flow channel while maintaining the open position, wherein the plug mechanism comprises a substantially streamlined profile when the plug mechanism is in the open position with respect to the plunger body and flow channel.

5. The apparatus of claim 4, wherein the plunger body and flow channel comprise a profile, wherein at least a portion of the profile is selected from the group consisting of: a substantially streamlined profile, a substantially tapered profile, and any combination thereof.

6. The apparatus of claim 5, wherein the plunger body and the plug mechanism are each configured to fall through continuous liquids in the gas producing well at a falling velocity relative to the continuous liquids velocity greater than about (150+50×M) feet per minute (ft/min), where M is either the mass in units of $lb_m$ of the plunger body or the mass in units of $lb_m$ of the plug mechanism.

7. The apparatus of any of claims 1 and 5, wherein the gas producing well is a high rate gas producing well of over about 200 thousand standard cubic feet per day (kscf/d).

8. The apparatus of claim 2, further comprising a locking device configured to impart a force on the plug mechanism in the open position, wherein the force is sufficient to maintain the plug mechanism in the open position as the plunger apparatus falls through continuous water at the falling velocity.

9. The apparatus of any of claims 1 and 5, further comprising a friction reduced coating on at least a portion of the plunger apparatuses, wherein the FRC is selected from the group consisting of: diamond-like carbon (DLC), advanced ceramics, graphite, and near-frictionless carbon (NFC).

10. An automatic plunger apparatus, comprising:

a plunger body having a first end, a second end, a substantially annular cross-section configured to form a flow channel through the plunger body from the first end to the second end, the plunger body able to travel within a tubing string; and a plug mechanism configured to operatively move between a closed position configured to obstruct the flow of fluids through the flow channel and an open position configured to permit the flow of fluids through a flow channel, wherein the plunger apparatus is configured to travel in the general direction of a gravitational force ("fall") in the open position until the plunger apparatus engages a first actuation force causing the plug mechanism to automatically move to the closed position.

11. The apparatus of claim 10, wherein the plug mechanism is further configured to travel against the general direction of the gravitational force in the closed position until the plunger apparatus engages a second actuation force causing the plug mechanism to automatically move to the open position.

12. The apparatus of claim 11, further comprising:

a support element configured to operatively engage the plug mechanism and fixedly attach to the flow channel; and a locking apparatus having an actuation member operatively engaged with the plug mechanism and the support element, further comprising:

a first end configured to extend beyond an outer surface of the plug mechanism when the valve element is in the open position and to engage the plug mechanism in the open position until the first actuation force causes the actuation member to disengage from the plug mechanism and forces the plug mechanism to the closed position, and a second end of the actuation member configured to extend beyond an upper portion of the support element when the plug mechanism is in the closed position and to engage the plug mechanism in the closed position until a second actuation force causes the actuation member to disengage from the plug mechanism and forces the plug mechanism to the open position.

13. The apparatus of claim 12, wherein the plunger body and the plug mechanism are configured to maintain the open position when the plug mechanism engages a hydrodynamic drag force caused by a flow of continuous liquids in a gas producing well.

14. The apparatus of claim 11, further comprising:

a support element configured to operatively engage the plug mechanism and fixedly attach to the flow channel; and a locking apparatus, comprising:

at least one locking device configured to operatively engage the plug mechanism in the open position with a locking force, wherein the locking force is sufficiently large to hold the plug mechanism in the open position when the plug mechanism engages a hydrodynamic drag force caused by a flow of continuous liquids in a gas producing well, but wherein the locking force is sufficiently small that the plug mechanism moves to the closed position when the plug mechanism engages the first actuation force.

15. The apparatus of claim 14, wherein the at least one locking device is selected from the group consisting of: i) magnetic latches, ii) compression rings, iii) spring-loaded ball bearings, and iv) any combination thereof.

16. The apparatus of claim 13 or claim 14, wherein the first end of the plug mechanism has a streamlined shape, comprising a surface area sufficiently large to maintain the streamlined shape upon impact from the first actuation force, but sufficiently small to minimize a hydrodynamic drag force caused by contact with the continuous water in the gas producing well.

17. The apparatus of any one of claims 1, 4, 12, and 14, further comprising a side-wall geometry selected from the group consisting of: i) a solid ring sidewall, ii) a plurality of turbulent sealers along the sidewall, iii) a plurality of fluid sealing elements configured to generate an azimuthal variation of a toroidal vortex in the cavity geometry, iv) a shifting ring sidewall, v) a pad plunger sidewall having spring-loaded interlocking pads, vi) a brush type sidewall, and vii) any combination thereof.

18. The apparatus of any one of claims 1, 4, 12, and 14, wherein the plunger apparatus is configured to operate in a gas producing well comprising:

a lower stopper with a bumper spring configured to provide the first actuation force; and an upper stopper with a bumper spring and an extension rod configured to provide the second actuation force.

19. The apparatus of any one of claims 1, 4, 12, and 14, further comprising a diamond-like carbon coating on at least the plunger body.

20. The apparatus of any one of claims 1, 4, and 11, wherein at least the plug mechanism is configured to fall through continuous liquids in the gas producing well at a falling velocity relative to the continuous liquids velocity greater than about (120+80×M) feet per minute (ft/min), where M the mass in units of $lb_m$ of the plug mechanism.

21. A method of producing hydrocarbon-containing gas, comprising:

providing a hydrocarbon well having a wellbore, a flow line in fluid communication with the wellbore, a top portion with a tubing head stopper, and a bottom portion with a bottom bumper stopper;

producing a volume of liquids and a gaseous stream imparting a gaseous pressure from the bottom portion to the top portion of the wellbore; and operating an automatic plunger apparatus in the wellbore in a plunger lift cycle, the lift cycle comprising:

lifting at least a portion of the produced volume of liquids towards the top portion of the wellbore and out of the flow line utilizing the gaseous pressure from the bottom portion to the top portion of the wellbore, wherein the plug mechanism of the automatic plunger apparatus is operatively in a closed position with respect to the plunger body and flow channel;

impacting the tubing head stopper with the automatic plunger apparatus causing the automatic plunger apparatus to automatically change the operating state from the closed position to an open position with respect to the plunger body and flow channel;

descending the automatic plunger apparatus in the open position to the bottom of the wellbore, wherein a gravitational force on the plunger apparatus is greater than a combined drag force and pressure force on the plunger apparatus caused by the passage of the volume of fluids and the gaseous stream;

impacting the bottom bumper stopper with the automatic plunger apparatus causing the automatic plunger apparatus to automatically change the operating state from the open position to the closed position; and repeating the plunger lift cycle.

22. The method of claim 21, wherein the automatic plunger apparatus includes a plug mechanism and a plunger body, wherein the plug mechanism extends from the plunger body towards the bottom portion of the wellbore in the open position and comprises a substantially streamlined shape configured to fall through continuous water in the hydrocarbon well while maintaining the open position.

23. The method of claim 22, wherein the automatic plunger apparatus is configured to fall through continuous water in the gas producing well at a falling velocity relative to the continuous water velocity greater than about (150+50×M) feet per minute (ft/min), where M is the mass in units of $lb_m$ of the plunger body.

24. The method of claim 21, further comprising controlling the plunger lift cycle, comprising:

catching the automatic plunger apparatus at or near the top portion of the wellbore;

holding the automatic plunger apparatus for a period of time; and releasing the automatic plunger apparatus upon the occurrence of a condition in the wellbore.

25. A method of manufacturing the one-piece plunger apparatus of claim 1, comprising:

forming the plunger body out of a single piece of material;

fixedly attaching a support element to the plunger body within the flow channel; and slidably attaching a valve element to the support element.

26. The method of claim 25, further comprising slidably attaching a locking apparatus to the valve element.

27. The method of claim 21 or 25, further comprising forming multiple turbulent sealers each having at least one vortex generator on an outer surface of the plunger body.

28. The method of claim 21 or 25, further comprising applying a friction reduced coating on at least a portion of the plunger, wherein the FRC is selected from the group consisting of: diamond-like carbon (DLC), advanced ceramics, graphite, and near-frictionless carbon (NFC).

* * * * *